US007080686B2

(12) United States Patent
Beckhardt

(10) Patent No.: US 7,080,686 B2
(45) Date of Patent: Jul. 25, 2006

(54) DEVICES AND METHODS FOR EXTRACTION, TRANSPORTATION AND/OR RELEASE OF MATERIAL

(76) Inventor: David Beckhardt, 27451 Hillcrest Pl., Valencia, CA (US) 91354

( * ) Notice: Subject to any disclaimer, the term of this patent is extended or adjusted under 35 U.S.C. 154(b) by 87 days.

(21) Appl. No.: 10/706,214

(22) Filed: Nov. 12, 2003

(65) Prior Publication Data

US 2004/0112607 A1 Jun. 17, 2004

Related U.S. Application Data

(60) Provisional application No. 60/425,932, filed on Nov. 13, 2002.

(51) Int. Cl.
*E21B 27/00* (2006.01)
*B67C 3/16* (2006.01)

(52) U.S. Cl. ..... 166/107; 222/356; 222/457; 137/205

(58) Field of Classification Search ..... 166/162, 166/163, 311, 105.1, 107; 222/356, 152, 222/457; 137/205
See application file for complete search history.

(56) References Cited

U.S. PATENT DOCUMENTS

| | | | | |
|---|---|---|---|---|
| 565,763 | A | 8/1896 | Lowderbaugh | |
| 1,055,385 | A | 3/1913 | Cahill | |
| 1,073,433 | A | 9/1913 | Meyer | |
| 1,431,396 | A | 10/1922 | Gruber | |
| 1,561,049 | A * | 11/1925 | Bonner et al. | 166/105.1 |
| 1,644,350 | A | 10/1927 | Palmer | |
| 2,091,929 | A | 8/1937 | Kappenberg | |
| 2,196,323 | A | 4/1940 | Norton et al. | |
| 2,336,314 | A | 12/1943 | Swan | |
| 2,372,628 | A | 3/1945 | Logan et al. | |
| 2,399,665 | A | 5/1946 | Deardorff | |
| 2,401,871 | A * | 6/1946 | Heeter | 166/165 |
| 2,465,563 | A * | 3/1949 | Abrams | 436/29 |
| 2,511,493 | A | 6/1950 | Cerruti | |
| 2,627,926 | A * | 2/1953 | Henry | 166/107 |
| 2,701,079 | A | 2/1955 | Buchler | |
| 2,702,125 | A | 2/1955 | Willinger et al. | |
| 2,718,308 | A * | 9/1955 | Le Bus | 210/532.1 |
| 2,783,716 | A * | 3/1957 | Varner | 137/140 |
| 4,190,113 | A | 2/1980 | Harrison | |

(Continued)

OTHER PUBLICATIONS

Jan Way, "Fun Coils & Silly Straws", pp. 1-2, printout from www.janway.com/funcoils_sillystraws.htm on Oct. 19, 2003.

(Continued)

*Primary Examiner*—David Bagnell
*Assistant Examiner*—Daniel P Stephenson
(74) *Attorney, Agent, or Firm*—Mitchell, Silberberg & Knupp LLP

(57) ABSTRACT

Provided are methods and apparatuses for extracting, transporting and/or releasing various kinds of liquid and semi-liquid materials. The materials may have very high viscosity and may include solids. Generally speaking, the apparatus includes a container, a gateway that functions as a valve without moving parts, and a means for controlling air pressure within the container. In addition, the apparatus may include flexible hoses and/or a separator for separating the solids in the material from the liquids. Applications include industrial and manufacturing processes, construction, dredging, remediation, laboratory, and home-based uses. When used in wells, the invention can bail water, oil, and sediment (cleanout operations). The tools according to the present invention are scalable to nearly any size.

24 Claims, 9 Drawing Sheets

U.S. PATENT DOCUMENTS

| | | | | |
|---|---|---|---|---|
| 4,493,383 | A | 1/1985 | Williams et al. | |
| 4,584,733 | A | 4/1986 | Tietge et al. | |
| 4,711,299 | A | 12/1987 | Caldwell et al. | |
| 4,935,980 | A | 6/1990 | Leginus et al. | |
| 5,093,085 | A | 3/1992 | Engstrom et al. | |
| 5,139,089 | A | 8/1992 | Wacker | |
| 5,699,838 | A | 12/1997 | Catallo et al. | |
| 5,772,402 | A * | 6/1998 | Goodman | 417/118 |
| 6,158,512 | A | 12/2000 | Unsgaard | |
| 6,189,617 | B1 * | 2/2001 | Sorhus et al. | 166/311 |
| 6,196,319 | B1 | 3/2001 | Henskens et al. | |
| 6,213,171 | B1 | 4/2001 | Saint-Ramon et al. | |
| 6,312,031 | B1 | 11/2001 | Norton, Jr. | |
| 6,360,921 | B1 | 3/2002 | Boos et al. | |
| 6,463,952 | B1 | 10/2002 | Stevens | |
| 6,464,012 | B1 * | 10/2002 | Strickland | 166/369 |

OTHER PUBLICATIONS

Rola-Chem/Paradise Industries, "Paradise Industries—Products—SpaVac", p. 1, prinout from www.paradiseind.com/spavac.html on Dec. 30, 2003.

* cited by examiner 300
305
306
303
304
306
210
200

307

60
309
360
361

20
12
14

60
310A
308
20

DEVICES AND METHODS FOR EXTRACTION, TRANSPORTATION AND/OR RELEASE OF MATERIAL

Priority is claimed to U.S. Provisional Patent Application Serial No. 60/425,932, filed on Nov. 13, 2002, and titled "Materials Handling Device", which application is incorporated by reference herein as though set forth herein in full.

BACKGROUND OF THE INVENTION

1. Field of the Invention

The present invention pertains to devices and methods for the extraction, transportation and/or release of materials, such as may be used in connection with well-cleanout operations.

2. Description of the Related Art

Solid waste landfills often have gas wells to extract methane gas. Gas is extracted from the top of the well by applying suction to the well casing. Landfills also often have systems to remove liquids, called "leachate", that collect in sumps at the bottom, on an impervious liner. The conventional leachate removal system often includes a "riser" pipe, similar in concept to a well casing. The riser pipe provides an open path for a pump to be lowered to the sump, for the pump's service lines, and for periodic removal of the pump.

These gas wells and riser pipes can be vertical, inclined, straight, curved, have multiple curves in more than one direction, be partially constricted and/or have uneven inside surfaces. Such wells may be constructed in this manner (e.g., at an angle of up to 60 degrees away from vertical) and, in addition, a gas well that initially was straight can become bent or curved into a circuitous path due to shifting of the landfill material. Such gas wells and riser pipes usually are between 6 inches and 24 inches in diameter, are made of steel or plastic pipe, and can be more than 300 feet deep. They often contain methane gas, a by-product of solid waste decomposition, which can be combustible or explosive when mixed with oxygen in the air and ignited. The temperature can reach 140 degrees Fahrenheit or more.

Such gas wells and riser pipes sometimes accumulate a mixture of liquid, sediment, sand, scale, rocks, floating items and/or debris ("Material") that reduces or inhibits one's ability to extract the gas and/or pump the leachate by conventional means. When this problem becomes too severe, it often is necessary to abandon the well and drill a new one.

Accordingly, the present inventor has discovered that what is needed is a more efficient and cost-effective means for dealing with the accumulation of such Material. Toward this end, the present inventor has examined conventional cleanout tools used in other applications, but was unable to find any tool that would be appropriate or optimal for landfill-well cleanout.

For example, some conventional methods to clean water, oil or natural-gas wells utilize a pipe string that is relatively stiff. While this is appropriate in these applications, where the well has been drilled into the ground and therefore is relatively straight, such a pipe string generally cannot travel through casings that curve, bend, have partial restrictions, and/or have uneven inside surfaces. In addition, some of such conventional equipment has one or more valves that can stick or cause clogs, making the equipment ineffective and/or necessitating frequent service. Further, some of such conventional equipment requires the use of electricity within the well, which can spark and ignite the combustible methane if it were used for landfill-well cleanout.

Some existing methods to clean storm drains or sewers utilize suction, but such methods typically cannot suck such Materials or similar mixtures to the necessary height in connection with the foregoing problem concerning landfill-well cleanout.

SUMMARY OF THE INVENTION

The present invention addresses the foregoing landfill-well cleanout problem by providing suction-based tools which, in the preferred embodiments of the invention, utilize various combinations of: an air-pressure control device, a gateway that functions as a valve without moving parts, flexible hoses, and/or a separator for separating some solids in the Material from the liquids. Although initially motivated by the landfill-well-cleanout problem described above, tools according to the present invention may be utilized in a much wider variety of applications and generally are scalable to nearly any size.

Thus, in one aspect the invention is directed to an apparatus for extracting, transporting, and/or releasing liquid or semi-liquid material. The apparatus includes a container, an inlet/outlet disposed beneath the container when the apparatus is in its operational orientation, and a gateway disposed between the container and the inlet/outlet. Pressure-control means controls air pressure within the container, and the inlet/outlet allows material to enter and exit the apparatus and has a minimum dimension that is at least ¼ inch in length. The gateway includes an enclosed channel that has an interior surface. In tracing a pathway through the enclosed channel of the gateway, starting from the inlet/outlet side of the gateway and ending at the container side of the gateway, with the apparatus in its operational position, the pathway first passes above a first point on the interior surface of the enclosed channel and then underneath a second point on the interior surface of the enclosed channel, with the first point being higher than the second point with the apparatus in its operational position.

In another aspect, the invention is directed to an apparatus for extracting, transporting, and/or releasing liquid or semi-liquid material. The apparatus includes a container, an inlet/outlet disposed beneath the container when the apparatus is in its operational orientation, and a gateway disposed between the container and the inlet/outlet. Pressure-control means controls air pressure within the container, and the inlet/outlet allows material to enter and exit the apparatus and has a size and a shape such that a vacuum alone would not be sufficient to prevent water from falling out of the inlet/outlet. The gateway includes an enclosed channel that has an interior surface. In tracing a pathway through the enclosed channel of the gateway, starting from the inlet/outlet side of the gateway and ending at the container side of the gateway, with the apparatus in its operational position, the pathway first passes above a first point on the interior surface of the enclosed channel and then underneath a second point on the interior surface of the enclosed channel, with the first point being higher than the second point with the apparatus in its operational position.

In another aspect, the invention is directed to an apparatus for extracting, transporting, and/or releasing liquid or semi-liquid material. The apparatus includes a container, an inlet/outlet disposed beneath the container when the apparatus is in its operational orientation, and a gateway disposed between the container and the inlet/outlet. Pressure-control means (which includes at least one of an electrically or mechanically actuated pump or valve) controls air pressure within the container, and the inlet/outlet allows material to enter and exit the apparatus. The gateway includes an enclosed channel that has an interior surface. In tracing a pathway through the enclosed channel of the gateway, starting from the inlet/outlet side of the gateway and ending at the container side of the gateway, with the apparatus in its operational position, the pathway first passes above a first point on the interior surface of the enclosed channel and then underneath a second point on the interior surface of the enclosed channel, with the first point being higher than the second point with the apparatus in its operational position.

The apparatuses described above generally can permit material to be drawn in, retained, transported and then discharged without the use of moving parts in the vicinity of the material in order to hold the material within the apparatus. Generally speaking, the apparatuses according to the present invention will be readily mobile at least to some extent, in order to accommodate the transportation of materials. For example, a well-cleanout tools according to the present invention may be truck or trailer mounted for transportation to different sites. Other implementations of the present invention may be smaller and more portable, including hand-operated devices for use in the home or laboratory and machine-operated devices, e.g., for use in manufacturing.

In more particularized aspects, the gateway is disposed in close proximity to the inlet/outlet. This feature generally will be desirable in order to minimize the amount of material that is able to fall out of the inlet/outlet. For example, the gateway preferably is no more than six inches from the inlet/outlet when used without a separator in a well cleanout application. However, the actual distance generally will depend upon the general scale of the apparatus, whether a separator is used and how the apparatus is fabricated. In order to accomplish the desired purpose, the gateway generally will not be more than 5–10 feet from the inlet/outlet.

In certain embodiments, it is also preferable to make the apparatus according to the present invention as flexible as possible. More specifically, all or nearly all of the components (except for the smaller components and/or couplings) preferably are flexible to permit such apparatuses to travel through circuitous well casings.

Still further, an apparatus according to the present invention generally may be scaled to nearly any size, from a number of inches to several hundred feet in length, depending upon the desired application.

In another aspect, the invention is directed to an apparatus for extracting, transporting, and or releasing liquid or semi-liquid material, and includes: a container, an inlet/outlet disposed beneath the container when the apparatus is in its operational orientation, and a separator that is disposed between the inlet/outlet and the container. The inlet/outlet allows material to enter and exit the apparatus. In addition, a provided pump is configured to evacuate air out of the container. The separator includes a vertically extending first tube enclosed within a vertically extending second tube, with the first tube being open at its top, and the second tube having a bottom surface for collecting solids that spill out of the top of the first tube.

The foregoing apparatus can permit withdrawal of solid pieces of material from a well or in similar applications. The present invention also is directed to methods for utilizing the foregoing apparatuses. In one, material is repeatedly drawn into and then flushed out of the apparatus, thereby filling the separator prior to removing the apparatus from the well or other collection site. Such a technique often can increase the efficiency with which solid materials are removed.

The foregoing summary is intended merely to provide a brief description of the general nature of the invention. A more complete understanding of the invention can be obtained by referring to the claims and the following detailed description of the preferred embodiments in connection with the accompanying figures.

DESCRIPTION OF THE PREFERRED EMBODIMENT(S)

A material handling device according to the present invention most often is used for acquiring, holding and then releasing fluids and/or mixtures of fluids and solids. Generally, this is done by lowering an opening for the device into a pool of Material, sucking some of the Material into the device, removing the device from the pool of Material, lifting or moving the device to an appropriate location, and then discharging the Material. Based upon the unique configuration of a device according to the present invention, such a device often can handle viscous fluids, mixtures that are difficult to pump, and mixtures that would be degraded by moving mechanical parts. In addition, such a device often will be effective in applications where the material is not already in a movable container.

General Configuration/Concept.

As indicated above, a device according to the present invention typically operates by varying the air, or other gas, pressure within the device, causing a portion of the subject Material to be acquired, held, and then released, in a cycle that can be repeated numerous times in order to remove a desired quantity of Material.

Figure 1:
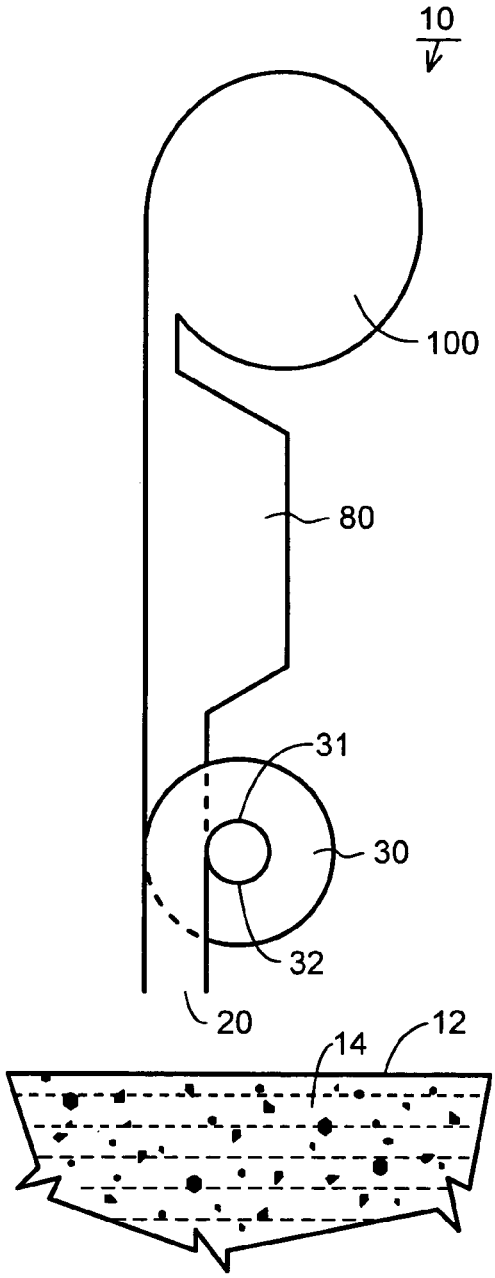
FIG. 1 provides a conceptual illustration of a material-handling device according to the present invention.

One representative configuration of a device 10 according to the present invention is shown conceptually in FIG. 1. As shown, device 10 is positioned for extracting, moving and then discharging Material 14 from a pool 12, and primarily consists of four components: an inlet/outlet 20, a gateway 30, a container 80, and an air-pressure-control device 100, such as a vacuum pump and/or a valve for opening to a space having a different air pressure. As will become apparent in the following discussion, each of the foregoing components may be configured in a variety of different ways. The device 10 is a generic example of the device according to the present invention. Accordingly, in addition to identifying particular elements within FIG. 1, the foregoing element numbers often are used generically below to refer to the subject component, irrespective of the specific configuration thereof.

The Inlet/Outlet

Inlet/outlet 20 is a simple opening, typically in or near the bottom of device 10. As such, inlet/outlet 20 often will be nearly indistinguishable from gateway 30 or whatever other component is immediately adjacent to the bottom of device 10.

The Gateway

The gateway 30 of the present invention functions as a valve, controlling the flow of Material, when used in combination with the arrangement of other components of device 10. Generally speaking, a gateway 30 prevents Material 14 from falling out of the bottom of a material-handling device 10 according to the present invention when the device 10 is removed from the pool 12 of Material 14 and low pressure is maintained within device 10. For example, with the inlet/outlet 20 immersed within a pool 12 of Material 14, the Material 14 may be drawn up into device 10 by evacuating air from device 10 or otherwise creating a vacuum (or a partial vacuum) within the device 10. Even with this vacuum maintained, however, without the use of a gateway 30, withdrawing inlet/outlet 20 from pool 12 would, under certain circumstances, cause the Material 14 within device 10 to fall out of the bottom of device 10 through inlet/outlet 20.

Ordinarily, if the inlet/outlet 20 is small enough and low air pressure is maintained within device 10, the atmospheric pressure will be sufficient to retain the withdrawn material within device 10, even in the absence of a gateway 30. Even in this case, a certain amount of tension exists along the surface of the Material 14 at the bottom of inlet/outlet 20. When inlet/outlet 20 is sufficiently small, this tension generally is not adequate to break such surface.

However, if the inlet/outlet 20 is made sufficiently large, only a gateway according to the present invention (or some other device, such as a mechanical valve with moving parts) will prevent the Material 14 from falling out. In this regard, the present inventor has recognized that as the inlet/outlet 20 becomes larger, it becomes increasingly likely that the surface of the Material 14 will rupture, allowing air to enter inlet/outlet 20. Once this occurs, air typically will flow unimpeded through inlet/outlet 20, destroying the vacuum (or low-pressure condition) within device 10. As a result, the air-pressure differential between the interior of device 10, and the ambient air no longer can support the Material 14 within device 10, and therefore the Material 14 falls out through inlet/outlet 20.

More specifically, it has been observed that an inlet/outlet 20 of less than ¼ inch in diameter (assuming a circular cross-section) typically will work to retain water alone, even without the use of gateway 30. However, when the diameter of inlet/outlet 20 becomes approximately ¼ inch, water will not be retained as consistently, with tilting of device 10 away from a fully vertical orientation causing some of the water to fall out. This effect is even more pronounced with the use of an inlet/outlet 20 having a diameter of approximately ⅜ inch. Once the diameter of the inlet/outlet 20 becomes approximately ½ inch, device 10 no longer is capable of retaining water within itself once inlet/outlet 20 is removed from the surface of the water, even if one attempts to maintain a vacuum within device 10.

As a result, the use of a gateway 30 according to the present invention may be particularly necessary if an inlet/outlet 20 having a minimum dimension of ¼, ½, ¾, 1, 2, 4 or more inches is utilized. For purposes of this discussion, the minimum dimension of an opening is the smallest distance across the opening. Thus, for example, a 2 inch by 4 inch rectangle will have a minimum dimension of 2 inches. As will become more apparent below, a device 10 according to the present invention may be scaled to nearly any size.

The foregoing measurements pertain to water only. Other types of fluids having different weights, viscosities and/or other properties may fall out of an inlet/outlet 20 more or less easily than water. In addition, the presence of solids mixed in with or suspended in the fluids, as well as the size and density of such solids, typically will affect the mixture's properties in this respect.

One potential solution to this problem is to form inlet/outlet as a cluster of parallel-connected tubes or conduits, each having an opening that is small enough to prevent the Material 14 from falling out. However, such a solution would not make effective use of the available cross-sectional area (which is limited in many applications) and also would prevent the acquisition of solid pieces of Material 14 that are larger than the relatively small openings of the individual conduits.

In order to address these problems, a gateway 30 according to the present invention or a mechanical valve typically must be utilized to retain the Material 14. However, as noted above, the use of a mechanical valve has its own problems.

In the specific embodiment shown in FIG. 1, the gateway 30 is a tube or fabricated instrument that is shaped with pathways that guide material over an internal "weir" 31 and under an internal "header" 32, with the weir 31 being higher than the header 32. The particular gateway 30 shown in FIG. 1 generally will be formed as a unitary piece having a circular cross-section and is merely one example of a gateway according to the present invention; other examples are described below. However, any gateway used in the present invention preferably will utilize a similar weir/header configuration.

As will become apparent from the discussion below, the weir 31 and the header 32 are simply points on the internal surface of the pathway within the gateway 30 that satisfy the foregoing requirements, i.e., that the Material 14 must first pass above the weir 31 and then under the header 32, and that the weir 31 must be higher than the header 32. The foregoing requirements, together with the requirement that the container 80 be higher than the inlet/outlet 20 (i.e., that the gateway 30 effects a net increase in the elevation or height of the Material 14), constrain the design of the gateway 30 in certain respects, as will become apparent below.

Another way to characterize this aspect of a gateway 30 according to the present invention is that Material 14 drawn through the gateway 30 travels from a relatively net lower elevation to a relatively net higher elevation, but within the gateway 30 there is at least one segment of the pathway (i.e., that portion between the weir 31 and the header 32) in which the elevation of the Material 14 actually decreases. As a result of this configuration, even if the surface of the Material 14 that is exposed to the ambient air becomes ruptured, air is prevented from moving through the gateway 30 after entering through inlet/outlet 20, much in the same way that sewer gases are blocked by a plumbing trap. Without the ability for air to pass through the gateway 30, the relative low pressure within device 10 is maintained and, therefore, atmospheric pressure continues to hold the Material 14 within material-handling device 10.

For the foregoing reasons, the weir 31 should be higher than the header 32, including when the device 10 might be inclined from a fully vertical orientation during use. During use, there will be times when Material 14 does not completely fill the gateway 30 and a surface of liquid will exist between the weir 31 and header 32. In an ideal condition, the surface of the liquid between the weir 31 and header 32 would be level and still, and therefore the weir 31 would need to be only marginally higher than the header 32, for example, by a vertical distance that is only 1% of the lateral distance from the weir 31 to the header 32. In practice, however, the gateway 30 may be subject to vibration, sway, or other motion that could cause the surface of the liquid between the weir 31 and header 32 to be non-level and/or in motion relative to the gateway 30. As a result, preferably the weir 31 would be higher than the header 32 by 5%, 10%, 20%, 30%, 40%, 50%, 60%, 70%, 80%, 90%, 100%, 150%, 200%, or more than 200% of the lateral distance from the weir 31 to the header 32. If the weir 31 is not straight and level, and/or if the header 32 is not straight and level (for example, if the weir 31 and/or header 32 are a portion of a round tube), the lowest portion of the weir 31 should be higher than the highest portion of the header 32, e.g., by the above minimum relative vertical distances. It is also noted that in the preferred embodiments of the invention, the pathways of the gateway 30 should be large enough to allow solids, if present, in the Material 14 to pass.

Figure 2:
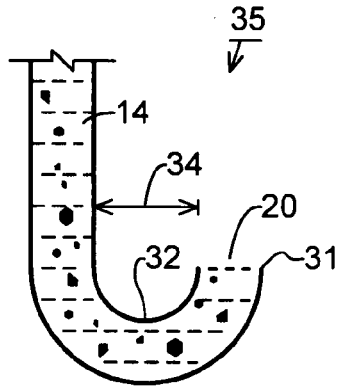
FIG. 2 is a cross-sectional view of a gateway according to a first representative embodiment of the present invention.

The simplest example of a gateway 30 according to the present invention is the hook-shaped gateway 35 illustrated in FIG. 2, which generally will be formed as a unitary piece having a circular cross-section. However, any other cross-sectional shape may instead be used. The gateway 35 is shown in FIG. 2 in its state after having been removed from a pool 12 of Material 14, with a relative low pressure maintained above gateway 35. As shown, when tracing a pathway through the gateway 35, the Material 14 first travels above (or at least even with) a weir 31 and then goes underneath a header 32, with the weir 31 being higher than header 32. Therefore, air is prevented from entering inlet/outlet 20, for the reasons described above, and the Material 14 remains at the same level as inlet/outlet 20, largely irrespective of the size of inlet/outlet 20.

Figure 3:
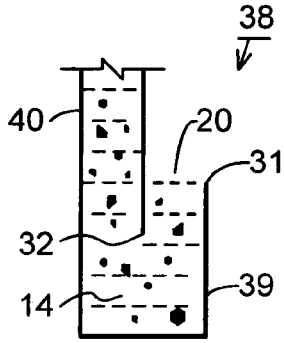
FIG. 3 is a cross-sectional view of a gateway according to a second representative embodiment of the present invention.

A similar gateway is gateway 38, shown in FIG. 3. As shown, gateway 38 also includes a weir 31 and a header 32. Also, the path that Material 14 travels in moving from the inlet/outlet 20 through the gateway 38 is similar to the corresponding path that the Material 14 travels in gateway 35. That is, the Material 14 starts at a local high point at inlet/outlet 20, moves downwardly until it passes underneath header 32, and then ascends upwardly through the opposite end of gateway 38. However, the actual configuration of gateway 38 is somewhat different than gateway 35, omitting the gap 34 that is present in gateway 35. As a result, gateway 38 generally will be more space-efficient than gateway 35. Due to the difference in the size of bottom portion 39 as compared to top portion 40 of gateway 38, the cross-sections of these elements preferably are square or rectangular, so as to provide a sizable common wall. However, any other cross-sectional shape may instead be used.

Similar to FIG. 2, the illustration in FIG. 3 shows the condition of gateway 38 after it has been submerged in the pool 12 of Material 14, at least some of the Material 14 has been drawn up into gateway 38 by evacuating air therefrom, and then gateway 38 has been removed from the pool 12 with the relative low pressure maintained. Under these circumstances, for similar reasons mentioned above, the air-pressure differential maintains the level of the Material 14 at the inlet/outlet 20.

Figure 4:
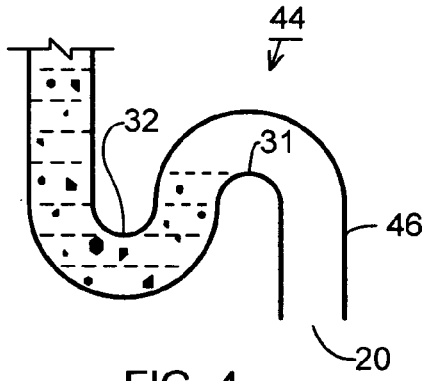
FIG. 4 is a cross-sectional view of a gateway according to a third representative embodiment of the present invention.

FIG. 4 illustrates a gateway 44 that is similar to gateway 35 above, but that has an additional segment 46 extending from the inlet/outlet 20 to the weir 31. Thus, gateway 44 is configured similarly to a conventional plumbing trap. Once again, similar to the illustrations of the previous embodiments, gateway 44 is shown in FIG. 4 just after it has been removed from the pool 12 of Material 14. As shown, the Material 14 remains at the same level as weir 31. Initially, when gateway 44 is submerged into pool 12 and air is evacuated therefrom, the entire gateway 44 would be filled with Material. Maintaining the relative low pressure and removing gateway 44 from pool 12 in this example has caused the Material 14 between weir 31 and inlet/outlet 20 to fall out of inlet/outlet 20. This is because inlet/outlet 20 is sufficiently large to result in the rupturing of the surface of the Material 14, thereby permitting air to enter inlet/outlet 20. At the same time, the fact that weir 31 is higher than header 32 prevents any air entering inlet/outlet 20 from proceeding significantly beyond weir 31 (although it may be possible for some air to move slightly beyond weir 31 in the event that gateway 44 is tilted away from a perfectly vertical orientation). It should be appreciated that if the inlet/outlet 20 were smaller, removing gateway 44 from the pool 12 of Material 14 with the relative low pressure maintained might not result in any Material 14 falling out of inlet/outlet 20, leaving gateway 44 entirely full of Material 14.

Figure 5A:
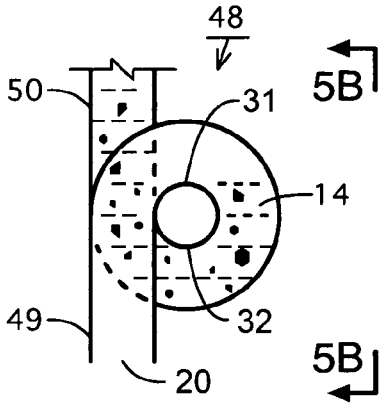
FIG. 5A is a front elevational view of a gateway according to a fourth representative embodiment of the present invention.
Figure 5B:
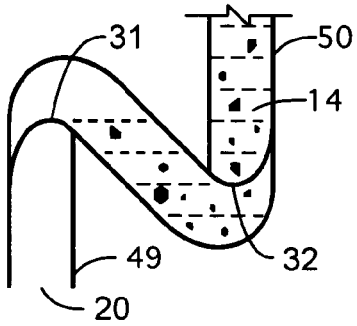
FIG. 5B is a side elevational view as seen from the perspective of 5B—5B indicated in FIG. 5A.

FIGS. 5A and 5B illustrate a gateway 48 configured as a tube formed into a loop, i.e., having an essentially constant radius of curvature. In this embodiment, the Material 14 flows in through the inlet/outlet 20, up through a lower vertical tube 49, loops over weir 31 and under header 32, and then moves up through an upper vertical tube 50. Once again, for the same reasons identified above, the Material 14 between weir 31 and inlet/outlet 20 falls out of inlet/outlet 20 as soon as gateway 48 is removed from the pool 12 of Material 14. However, the remainder of the Material 14 remains in gateway 48 and, accordingly, in the other portions of device 10 that are disposed above gateway 48.

Variations on the gateway 48 shown in FIGS. 5A and 5B are possible. For example, the lower vertical tube 49 and the upper vertical tube 50 may be moved closer to each other, in either or both dimensions in order to minimize the overall girth of the gateway.

Figure 6A:
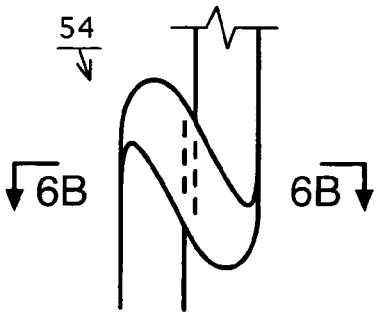
FIG. 6A is a front elevational view of a gateway according to a fifth representative embodiment of the present invention.
Figure 6B:
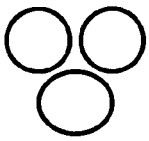
FIG. 6B is a cross-sectional view taken across the plane 6B—6B indicated in FIG. 6A.

The gateway 54 shown in FIGS. 6A and 6B illustrates this concept, in which the tubes used to form gateway 54 are moved closer to each other in both dimensions. Thus, the gateway 54 shown in FIGS. 6A and 6B generally is similar to the gateway 48 shown in FIGS. 5A and 5B, but is formed to minimize the overall girth of the gateway 54, for a given tube size.

Figure 7A:
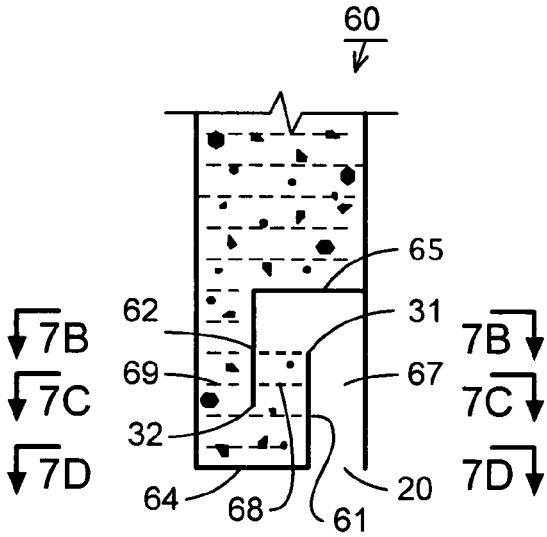
FIG. 7A is a conceptual illustration of a gateway according to a sixth representative embodiment of the present invention.
Figure 7B:
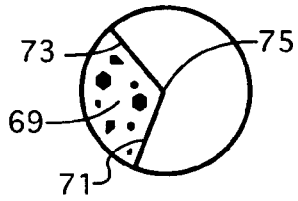
FIGS. 7B–7D are horizontal cross-sectional views of a gateway in accordance with the conceptual diagram shown in FIG. 7A, taken along the corresponding planes indicated in FIG. 7A.
Figure 7C:
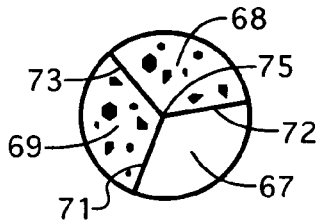
Figure 7D:
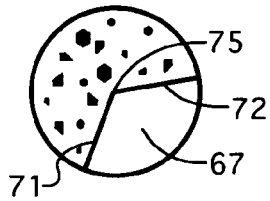

FIG. 7A illustrates a conceptual diagram of a gateway 60, and FIGS. 7B–7D illustrate cross-sections of an actual fabricated gateway 60, in accordance with the concept illustrated in FIG. 7A, that even better maximizes the cross-sectional area of the pathways within a given gateway girth. According to this embodiment, the gateway 60 can be of the same overall diameter (or girth) as the other portions of the device 10 of which the gateway 60 forms a part, as shown in FIG. 7A.

As shown in FIG. 7A, the general concept of the gateway 60 is that a weir 31 and a header 32 are formed within the interior space of gateway 60 by partitioning such interior space using dividing walls (shown conceptually as walls and 61 and 62) and end caps (shown conceptually as caps 64 and 65). Although the vertical ends of what is termed gateway 60 may be assigned more or less arbitrarily, in order to simplify the present discussion we will assume that end caps 64 and 65 terminate gateway 60. In this configuration, dividing wall 61 begins at end cap 64 (which is at the same level as inlet/outlet 20) and extends upwardly to a point just short of end cap 65. Similarly, dividing wall 62 begins at end cap 65 and extends downwardly to a point just short of end cap 64. At the same time, dividing walls 61 and 62 vertically overlap each other for some distance, thereby creating a weir 31 and a header 32. As a result of this configuration, three distinct channels 67–69 are formed. Preferably, the cross-sectional area (and the minimum dimension) of each of the three channels 67–69 is equal (or at least approximately equal) to the others, in order to maximize flow rates and to maximize the size of the largest solid that may pass through gateway 60, within the constraint of the overall girth requirement.

FIGS. 7B–7D illustrate cross-sections of an actual physical gateway 60 in accordance with the concept illustrated in FIG. 7A. As shown in FIGS. 7B–7D, the overall cross-section of gateway 60 is circular and is divided into three sections (or channels) of approximately equal size by dividing walls 71–73 that attach to the inside wall of gateway 60 and meet at a center line 75 (which is shown as a single point in the cross-sectional views of FIGS. 7B–7D, as center line 75 is orthogonal to the plane in which the cross-sectional views of FIGS. 7B–7D are taken). More detail regarding the physical arrangement of gateway 60 is presented below.

As in the previous embodiments, as shown in FIGS. 7A–7D, gateway 60 appears as it would after being withdrawn from the pool 12 of Material 14. Initially, the Material 14 would flow up through channel 67, over weir 31, down through channel 68, underneath header 32 and then up through channel 69 and into other portions of the device 10. Thus, while the inlet/outlet 20 remains within the pool 12 of Material 14, the entire gateway 60 typically would be full of the Material 14. Once again, however, once the device 10 is removed from pool 12, the Material 14 between inlet/outlet 20 and weir 31 falls out of inlet/outlet 20, as a result of air entering inlet/outlet 20. At the same time, such air is prevented from moving any further into gateway 60 due to the height difference between weir 31 and header 32.

As should be apparent, both of the gateways 54 and 60 shown in FIGS. 6A–6B and FIGS. 7A–7D, respectively, have shapes and configurations that would be most useful in confined locations. This is particularly important when a device 10 according to the present invention is to be used in applications such as well cleanouts. Configurations such as gateway 60 illustrated in FIGS. 7A–7D maximize the use of the available space and therefore currently are preferred.

The Container

The container 80 should be capable of resisting the force of air pressure outside, while air is evacuated from within the container 80 and while the resulting low pressure is maintained within the container 80. Container 80 can be of any shape that suits the application, considering girth, length, volume, and the nature of the material to be contained. For example, the shape can be designed to minimize the possibility of multiple pieces of solids forming a clog at the junction of the container 80 and the gateway 30.

Figure 8:
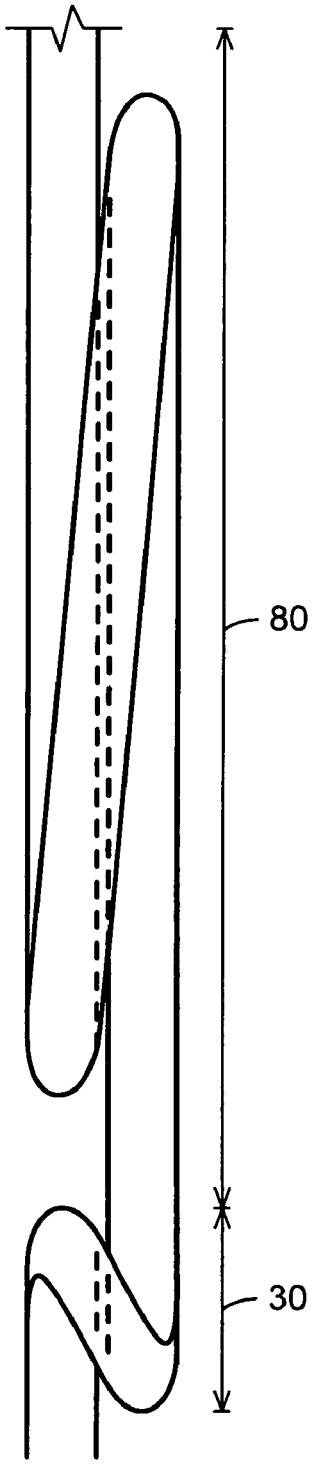
FIG. 8 is a front elevational view of the gateway and container portion of a material-handling device according to one embodiment of the present invention.

Further, the container 80 can be an extension of a tube that forms the gateway 30, in order to eliminate potential constrictions, such as represented by FIG. 8. The particular configuration of container 80 that is shown in FIG. 8 is similar to gateway 54 shown in FIGS. 6A and 6B, thereby providing a secondary (or backup) gateway that should help to retain at least some of the Material 14 should a problem occur with the gateway 30.

Figure 9:
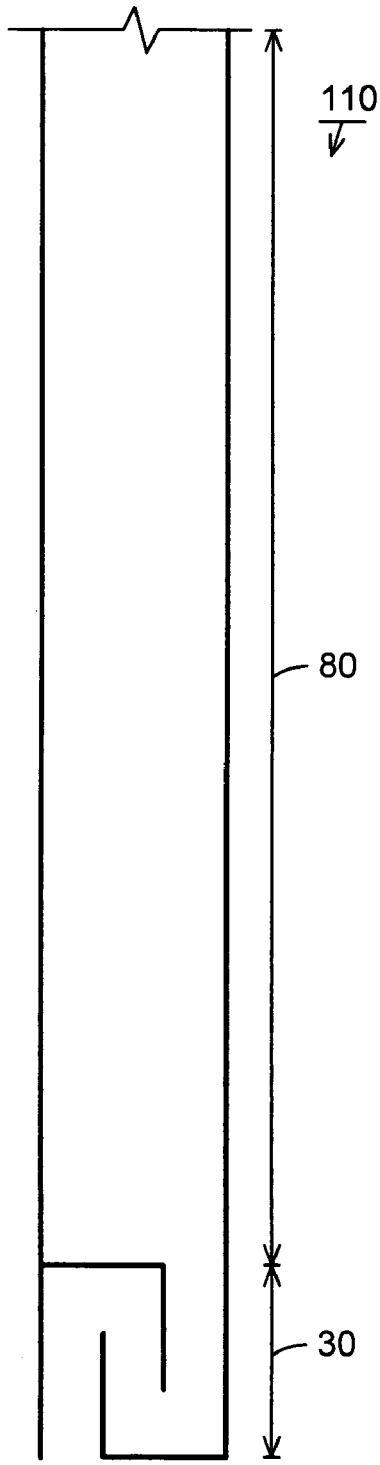
FIG. 9 is a conceptual view of the gateway and container portion of a material-handling device according to the present invention that utilizes a gateway similar to that shown in FIG. 7A.

FIG. 9 represents a combination 110 of a gateway 30 (of the type illustrated in FIGS. 7A–7D) and a container 80 that has a uniform girth, which is useful in confined locations. The combination 110 may be rigid or flexible along its length, although in the present embodiment, container 80 is flexible and gateway 30 is rigid. As indicated above, in a sense, the dividing line between container 80 and gateway 30 generally may be assigned arbitrarily, as the two are functionally identical above the top end cap of the gateway 30. However, because the gateway 30 preferably is rigid while the container 80 preferably is flexible, it generally will be desirable to limit the size of gateway 30 as much as possible, i.e., to terminate it at its end caps.

Pump or Other Air-Pressure Control Means

The air-pressure-control device 100 can be as simple as a rubber bulb or more complex, such as a powered machine (e.g., an electrical air pump, typically configured for generating a vacuum). Generally speaking, the air-pressure-control device 100 will be any electrically or mechanically actuated air-pressure control mechanism, such as a hand-operated pump, a foot-operated pump, a bellows, a simple mechanical valve, an electrically operable valve or an electrically driven or engine-driven pump. Preferably, air-pressure-control device 100 should have the ability to evacuate air from the container 80 (e.g., a vacuum pump), maintain the relative low air pressure, and subsequently allow air into the container 80. More preferably, pump 100 should also have the ability to pump air into container 80 at a pressure that is higher than the ambient atmospheric air pressure.

Alternatively, as described in more detail below, it is possible to replace pump 100 with a different type of device for controlling air pressure within device 10. For example, an air-pressure control device 100 for use in device 10 may be as simple as a mechanical or electromechanical valve for controlling the flow of ambient air into and out of container 80.

Technique for Using the Material-Handling Device

In use, a representative cycle for using a material-handling device 10 according to the present invention consists of:

1. Placing the opening 20 of the gateway 30 into the subject Material 14 from above.

2. Evacuating air (applying suction) at the top opening of the container 80, thereby decreasing the air pressure within the device 10. As the air pressure in the device 10 decreases, a portion of the subject Material 14 is pushed into and through the gateway 30 and then into the container 80 by the relatively higher air pressure outside the container 80.

3. When the desired quantity of Material 14 has accumulated in the container 80, the evacuation is stopped and the air pressure within the container 80 becomes stable at a relative low pressure.

4. The container 80 and the gateway 30 are lifted above the surface of the remaining Material 14. A small amount of the Material 14 between the weir 31 of the gateway 30 and the bottom opening 20 might fall out the bottom opening 20 of the gateway 30. The gateway 30 prevents the Material 14 in the container 80 and gateway 30, to the weir 31, from falling out, while the air pressure within the container 80 is stable at the low pressure. The acquired and held Material 14 is the load.

5. The load is conveyed to another location, such as above (depending upon the scale) the opening of a jar, a storage container, an inlet to a machine, or a truck.

6. The load is released by allowing air to enter the container through the top opening. As the air pressure within the container 80 increases, the load flows out through the bottom opening 20 of the gateway 30 until the container 80 is empty or nearly so. A small amount of Material 14 remains under the header 32 in the "U" portion of the gateway 30.

7. The device 10 is repositioned over the subject Material 14.

The foregoing cycle can be repeated any desired number of times.

Figure 10:
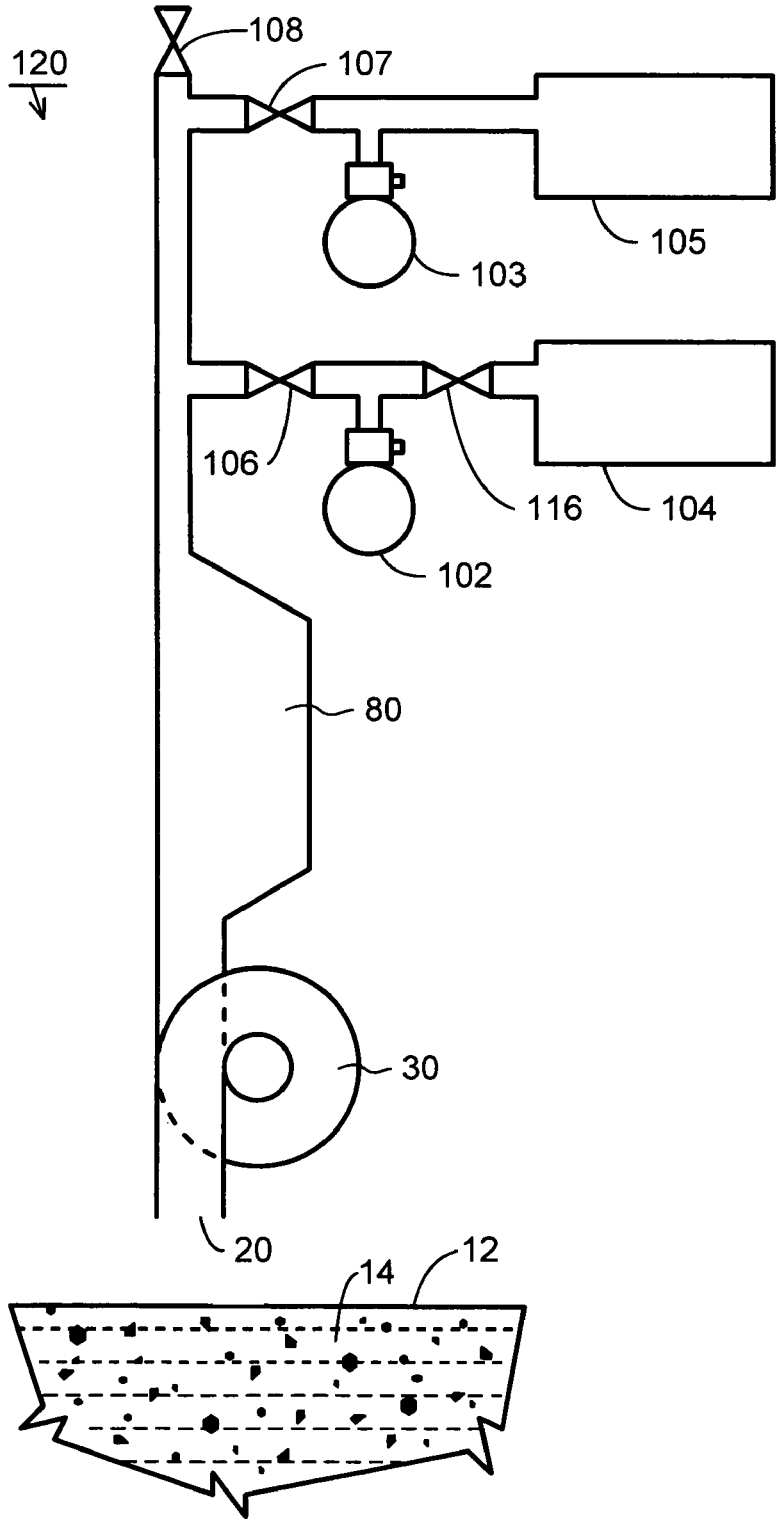
FIG. 10 is a conceptual illustration of an entire material-handling assembly according to the present invention.

Optional Components that Increase Functionality, Versatility and Economy, Particularly in Connection with a Commercial-Use Material-Handling Device FIG. 10 illustrates a device 120 according to an alternate embodiment of the present invention, which is better suited for commercial or industrial use. In this embodiment, device 120 includes the same components described above, including: an inlet/outlet 20, a gateway 30 and a container 80 for extracting Material 14 from a pool 12. However, in this embodiment the air-pressure-control device 100 includes: a vacuum pump 102; an air pump (or compressor) 103; a corresponding vacuum chamber 104 and air tank 105, respectively, for allowing faster evacuation of air from, and faster pressurization of, container 80; and corresponding mechanically and/or electrically operable control valves 106–108 for evacuating air from container 80, pressurizing container 80 and exposing container 80 to ambient air pressure, respectively. In addition, a mechanically and/or electrically operable valve 116 is provided between vacuum pump 102 and vacuum chamber 104. As a result, with vacuum pump 102 and air pump 103 on and valve 116 open, opening valve 106 causes air to be evacuated from container 80, opening valve 107 causes air to be pumped into container 80, and opening valve 108 equalizes the air pressure within container 80 to atmospheric pressure (which may result in air being drawn into container 80, air being vented from container 80, or no net air movement at all).

Adding a valve 106, 116, and vacuum chamber 104 typically will provide the following benefits:

1. The rate at which the load of Material 14 is drawn into the gateway 30 and container 80 can be substantially increased. This is achieved by closing the valve 106, opening valve 116, evacuating the chamber 104, then opening the valve 106. The "reserve" of partial vacuum in the chamber 104 can dramatically increase the rate at which the subject Material 14 flows into the gateway 30, increasing the velocity of fluid, and increasing the size and/or mass of solids that can be acquired or drawn into device 120.

2. The size and/or rate capacity of the vacuum pump 102 can be reduced, because the pump 102 can evacuate air from the chamber 104 nearly continuously, rather than operating only when the container 104 is to be filled.

Adding a valve 107, air tank 105, and air pump or compressor 103 has the following benefits:

1. The rate at which the load of Material 14 is released from the container 80 can be substantially increased. This is achieved by closing the valve 107, compressing air into the tank 105, then opening the valve 107.

2. Fluids with solids that might clump and clog can be forced at a pressure higher than ambient pressure, potentially dislodging the clog.

The advantages of including a valve 116 are described below.

In addition to the foregoing steps, by alternately applying suction and compression during the release phase of the cycle, material that might have become stuck often can be freed. Also, by alternately applying suction and compression during the acquisition phase, solids in the material 14 can be reduced to smaller pieces and/or mixed with liquid.

Figure 11:
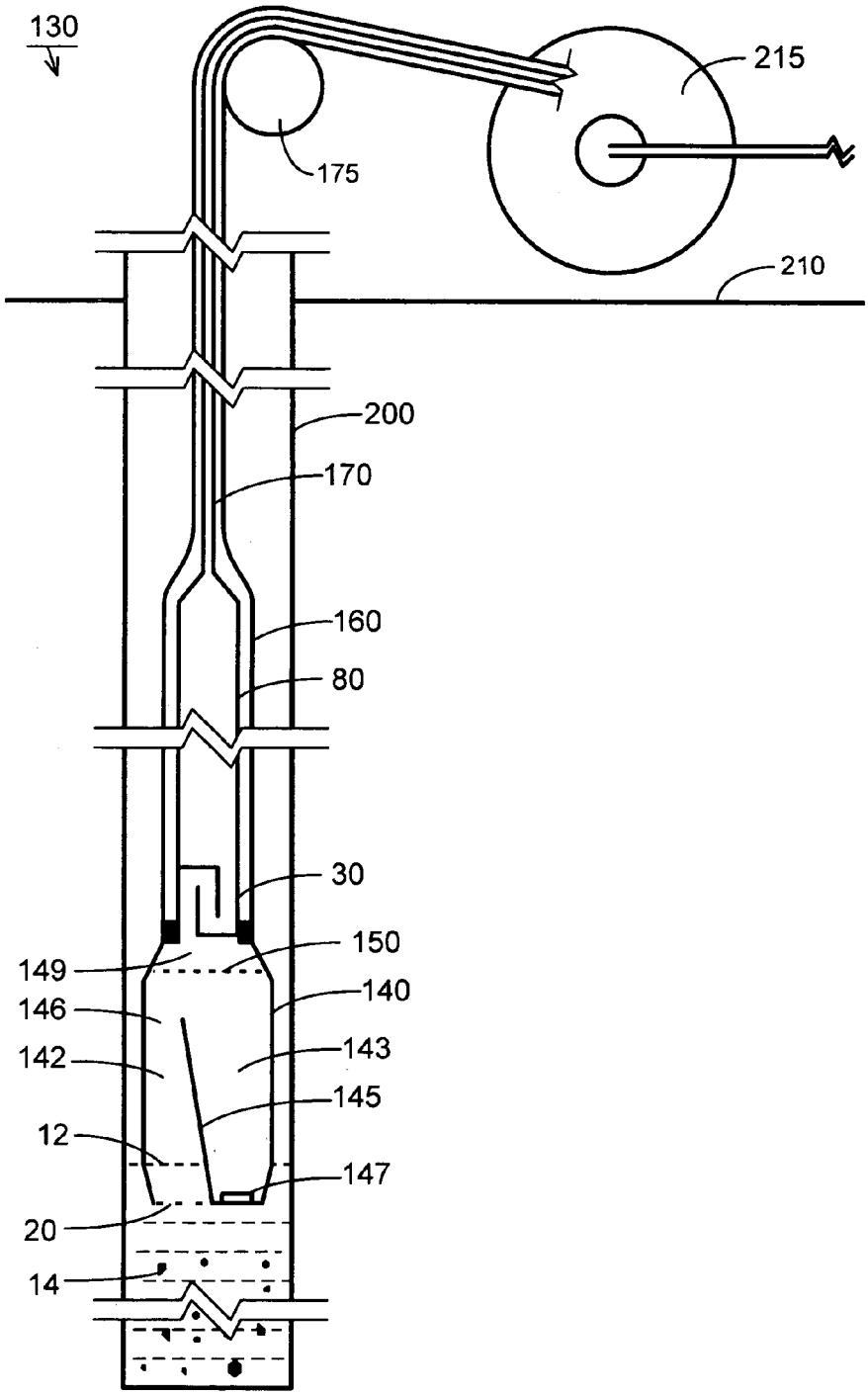
FIG. 11 is a conceptual illustration of a material-handling device according to the present invention in an operational environment.

FIG. 11 illustrates a device 130 in use while cleaning out a well 200, together with certain ancillary apparatuses described below, according to a representative embodiment of the present invention. Generally speaking, FIG. 11 shows material-handling device 130 in cross-section, although certain components, such as the gateway 30 are shown conceptually. At the very bottom of device 130 is an inlet/outlet 20 which may be covered with an optional screen to filter out the larger solid pieces.

Device 130 also includes a separator 140 which generally is used for capturing and storing the larger solid pieces suspended in the Material 14 that has been drawn into device 130. Generally speaking, separator 140 includes an inner chamber 142 that is enclosed within an outer chamber 143. Here, inner chamber 142 comprises a side portion of chamber 143 that has been separated from the remainder of chamber 143 by a dividing wall 145. The inlet/outlet 20 opens into chamber 142 which, in turn, has an open top 146 that opens into the remainder of chamber 143. The chamber 143, in turn, may be accessed either through chamber 142, as just described (primarily used for drawing Material 14 into chamber 143), or from its bottom surface by removing cap 147 (primarily used for emptying solids and other Material 14 from chamber 143). In addition, chamber 143 has an open top 149 (which may be provided with an optional screen 150 for filtering out the larger solid pieces) that opens into gateway 30 in the present embodiment of the invention.

Preferably, separator 140 is formed from a flexible material and may be sized as appropriate to fit inside the flexible support hose 160 (described below) or may be larger and connected below the flexible support hose 160. However, separator 140 may instead be implemented as a rigid structure. Additional details regarding the preferred embodiment of separator 140, as well as its operation, are described below.

Immediately above separator 140 is gateway 30. In the present embodiment, gateway 30 is configured similarly to gateway 60 shown in FIGS. 7A–7D. However, any other gateway 30 may instead be used. Also, in the current embodiment gateway 30 is implemented as a flexible device, integral with container 80 immediately above it, although it may instead be manufactured as a rigid component. As indicated in FIG. 11, the opening 149 between separator 140 and gateway 30 may be fitted with an optional screen for filtering solid pieces that might clog gateway 30.

Immediately above gateway 30 is container 80. In the present embodiment of the invention, container 80 is integral with gateway 30, is implemented as a flexible hose, and connects to the top of separator 140 using a clamp or other mechanical connection. However, it also may be configured as a rigid structure. In the embodiment shown in FIG. 11, container 80 is contained within a flexible support hose 160. However, in order to maximize the usable space within container 80, container 80 may instead be configured as a separate structure (which may connect to support hose 160 at its top end, as described in more detail below).

A pneumatic hose 170 attaches to the top of container 80. In the present embodiment of the invention, pneumatic hose 170 is enclosed within flexible support hose 160, thereby allowing support hose 160 to bear most of the weight of device 130, as well as to protect pneumatic hose 170 from frictional forces as the material-handling device 130 is lowered and raised through well 200. More specifically, pneumatic hose 170 preferably is significantly narrower than support hose 160, thereby allowing pneumatic hose 170 to snake through support hose 160. As a result, support hose 160 may stretch (typically due to the weight of material-handling device 130) much more than pneumatic hose 170. Even if pneumatic hose 170 is approximately the same length as support hose 160, the significantly stronger support hose 160 typically will prevent pneumatic hose 170 from stretching too much, even under the loads that are anticipated in connection with well-cleanout operations.

As shown in FIG. 11, support hose 160 (enclosing pneumatic hose 170) extends from above the Earth's surface 210 (where it is wound around a hose reel 215 having a swivel connector) across pulley 175 and down through well 200 to a sufficient distance that the inlet/outlet 20 is submerged within the pool 12 of Material 14, which may be 300 feet or more beneath the surface 210. This is the operational state of material-handling device 130. Above the surface 210, the pneumatic hose 170 emerges from the flexible support hose 160 and connects to the swivel connector on hose reel 215. Similar pneumatic hose 170 connects the other end of the swivel connector on hose reel 215 to the vacuum pump 102 and air pump 103 (through the valves 106, 116 and 107), as shown in FIG. 10.

It should be understood that although well 200 is illustrated in FIG. 11 as being entirely vertical, this is for ease of illustration only. In many practical applications, particularly in connection with landfill-well cleanout, the well pipe 200 often will follow a circuitous path having segments that are as much as 60 degrees from vertical, partly due to shifts in the landfill material and partly due to the way that the well was constructed. Recognizing such bends and twists in well pipe 200 provides additional incentive for increasing the height differential between the weir 31 and the header 32 in the nominal (i.e., fully vertical) orientation, so as to provide sufficient tolerances to accommodate such bends and twists. It is noted that another way to increase such tolerances is to configure gateway 30 such that the weir 31 is as close as possible to directly above the header 32 with gateway 30 in its nominal orientation.

Also, the existence of such bends and twists provides further incentive to manufacture as much of material-handling device 130 as possible so as to be flexible. As already noted, the support hose 160, pneumatic hose 170, container 80 and separator 140 preferably are all flexible, with only the gateway 30 and certain coupling components potentially being rigid.

The following are certain additional aspects of the material-handling device/assembly 130 according to the present embodiment of the invention.

1. The flexible support hose 160 should: contain the pneumatic hose 170, bend around the hose reel 215, bend through the curves in the well pipe (or casing) 200, withstand the tensile forces of the hanging device plus the weight of the load of Material 14 being removed, have a low coefficient of friction and resist abrasion from the inside of the casing of well 200.

2. The flexible support hose 160 may also contain the container 80, the gateway 30 and the separator 140. By containing these components in one hose 160, the smooth outer surface of the flexible support hose 160 and the uniform circumference reduces the possibility of a portion of the device 130 catching on a constricted area or an irregular surface inside the casing of well 200.

3. The pneumatic hose 170 should have an inside diameter that allows an adequate rate of air flow, resist the forces of a partial vacuum at expected temperatures, be flexible enough to wind around the hose reel 215 and bend over the pulley 175, and be stiff enough to meander inside the flexible support hose 160, but not kink.

4. The container 80 should resist the forces resulting from a partial vacuum in the container 80 at the expected temperatures. If the casing of well 200 or hole has bends, the container 80 should be flexible enough to bend through the curves. The container 80 may be sized to fit inside the flexible support hose 160.

5. The gateway 30 should have the general characteristics described earlier. In addition, for this form of the device 130, the gateway 30 may be shaped similar to gateway 54 or gateway 60, shown in FIGS. 6 and 7, respectively, so as to facilitate fitting into the casing of well 200 and optionally inside the flexible support hose 160.

6. The optional intake screen at the bottom inlet/outlet 20 of the gateway 30 should be selected to allow solids that are unlikely to get stuck in the device 130 above the intake screen to pass, while not allowing other solids to pass.

7. The separator 140 should be designed to pass through the casing of well 200, accept and hold larger solids, and allow the remaining Material 14 to flow through it. The separator 140 may be designed to fit inside the flexible support hose 160. An optional screen at the inlet of the separator 140 can be used to reduce the possibility of solids becoming stuck in the separator 140.

8. If there is liquid in the casing of well 200, to a height that would cause the lower portion of the device 130 to become buoyant, the device 130 can be used to remove most of the liquid until the separator 140 reaches the Material 14.

Alternatively, the lower portion of the device 130 can be made heavy enough to overcome the buoyancy and cause it to sink to the Material 14.

Embodiment of the Device that Operates Without a Pump.

A form of the device 10 that operates without a pump consists of a gateway 30, a container 80, and a valve 100 at the top of the container 80. Optionally, a pneumatic hose may exist between the container 80 and valve 100. This form of the device 10 should be effective when there is adequate liquid above the subject Material 14 and/or when the Material 14 will allow a portion of the device 10 to be forced into the Material 14.

In use, a representative cycle consists of:

1. Closing the valve 100.
2. Placing the opening 20 of the gateway 30 into the liquid and/or subject Material 14 from above.
3. The gateway 30 and container 80 are forced down through the liquid that exists above the subject Material 14 and/or forced into a portion of the subject Material 14. The force may be exerted by a structure pushing down from above, pulling down from below, and/or by the weight of a portion of the device, to overcome buoyancy.
4. The valve 100 is opened and Material 14 is pushed into the gateway 30 and container 80 due to the hydraulic pressure outside the submerged portion of the device 10. Air is expelled through the valve 100.
5. The valve 100 is closed.
6. The container 80 and the gateway 30 are lifted above the liquid surface. A portion of the Material 14 in the device 10 flows out the gateway 30, as the air pressure in the container 80 decreases to a low pressure. When equilibrium is reached, the Material 14 stops flowing out.
7. The gateway 30 prevents much of the Material 14 in the container 80 and gateway 30, to the weir 31, from falling out, while the air pressure within the container 80 is stable at the low pressure. The acquired and held Material 14 is the load.
8. The load is conveyed to another location, such as above (depending upon the scale) the opening of a jar, a storage container, an inlet to a machine, or a truck.
9. The load is released by allowing air to enter the container through the valve 100. As the air pressure within the container 80 increases, the load flows out through the bottom opening 20 of the gateway 30 until the container 80 is empty or nearly so. A small amount of mixture remains under the header 32 in the "U" portion of the gateway 30.
10. The device 10 is repositioned over the subject material.

The foregoing cycle can be repeated as many times as desired.

Modified Commercial/Industrial Material-Handling Device

Figures 12, 13, 14, 15, 16:
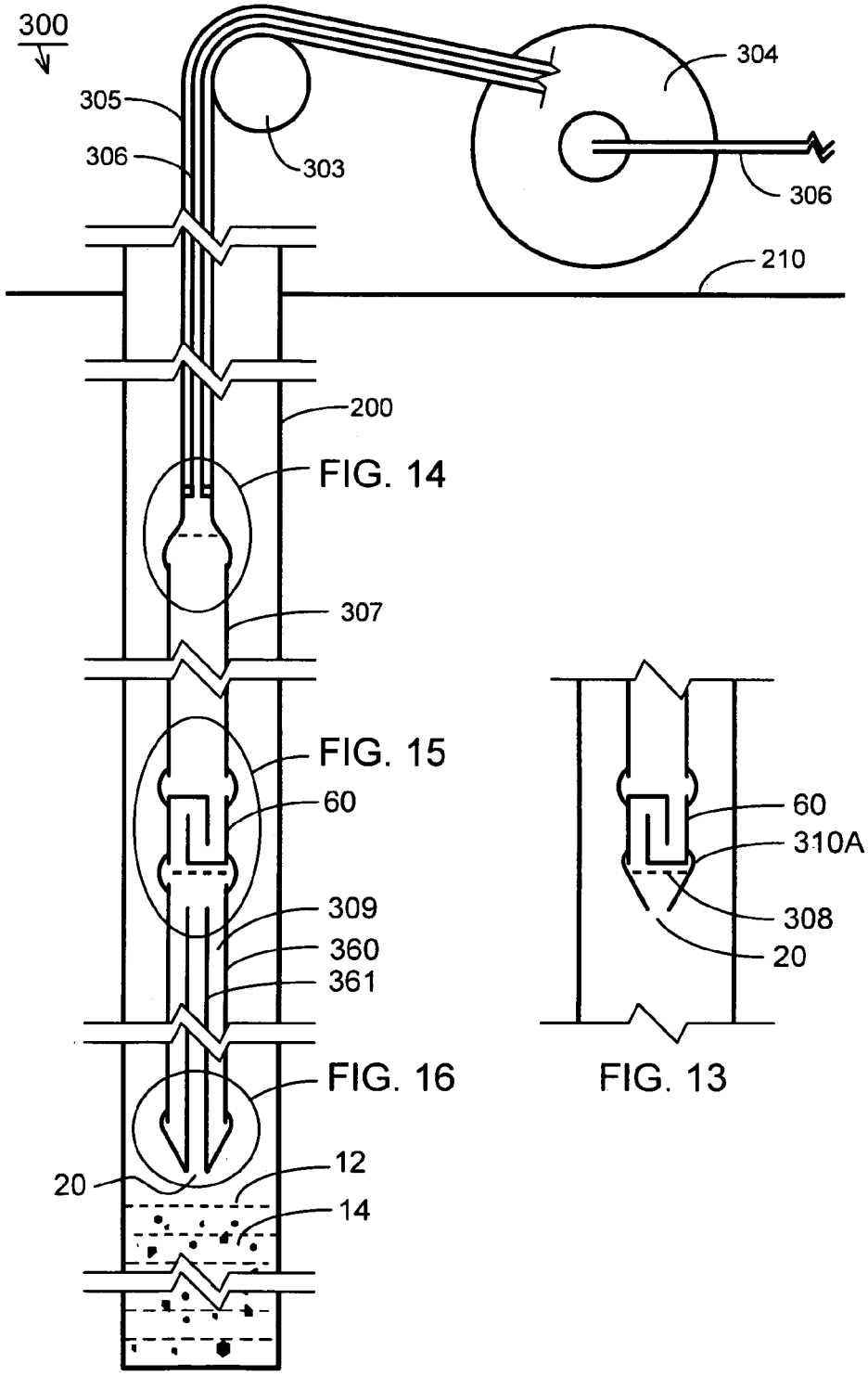
FIG. 12 is a conceptual view of a material-handling device according to an alternate embodiment of the present invention, in an operational environment.
FIG. 13 is a conceptual illustration of a gateway terminating in an inlet/outlet according to the present invention.
FIG. 14 is a cross-sectional view showing the connection between the flexible support hose and pneumatic hose, on the one hand, and the container, on the other, in the material-handling device shown in FIG. 12.
FIG. 15 is a cross-sectional view showing a gateway and its connection to the container and the separator in the material-handling device shown in FIG. 12.
FIG. 16 is a cross-sectional view showing the bottom portion of the separator, together with the inlet/outlet, in the material-handling device shown in FIG. 12.
Figure 14:
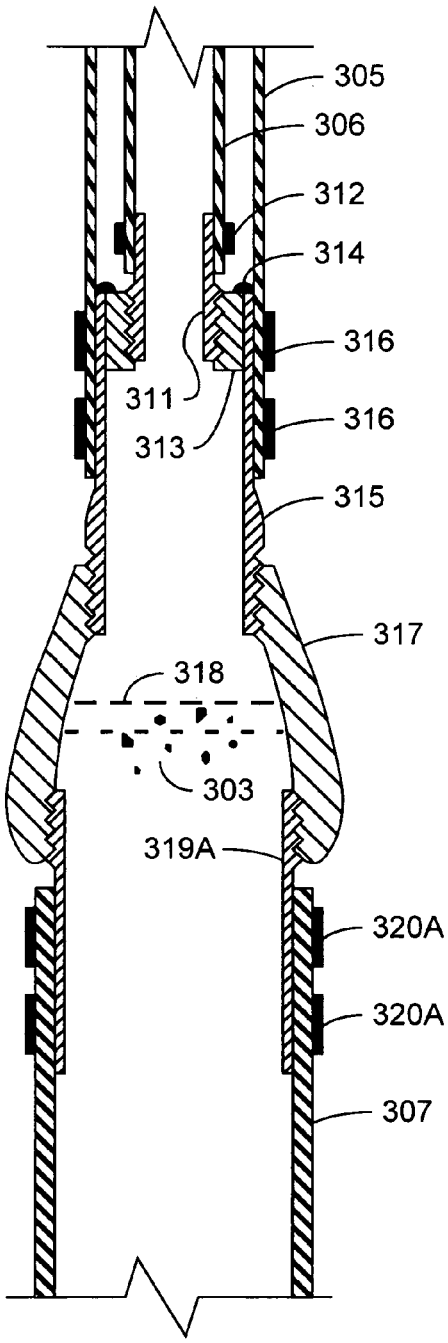
Figure 15:
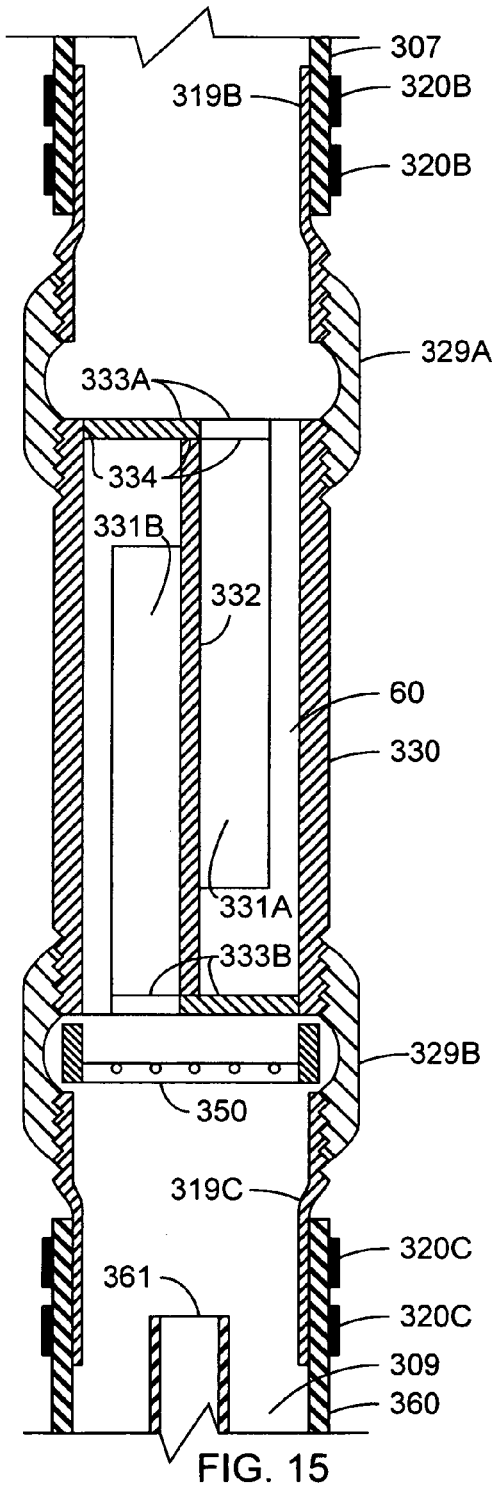
Figure 16:
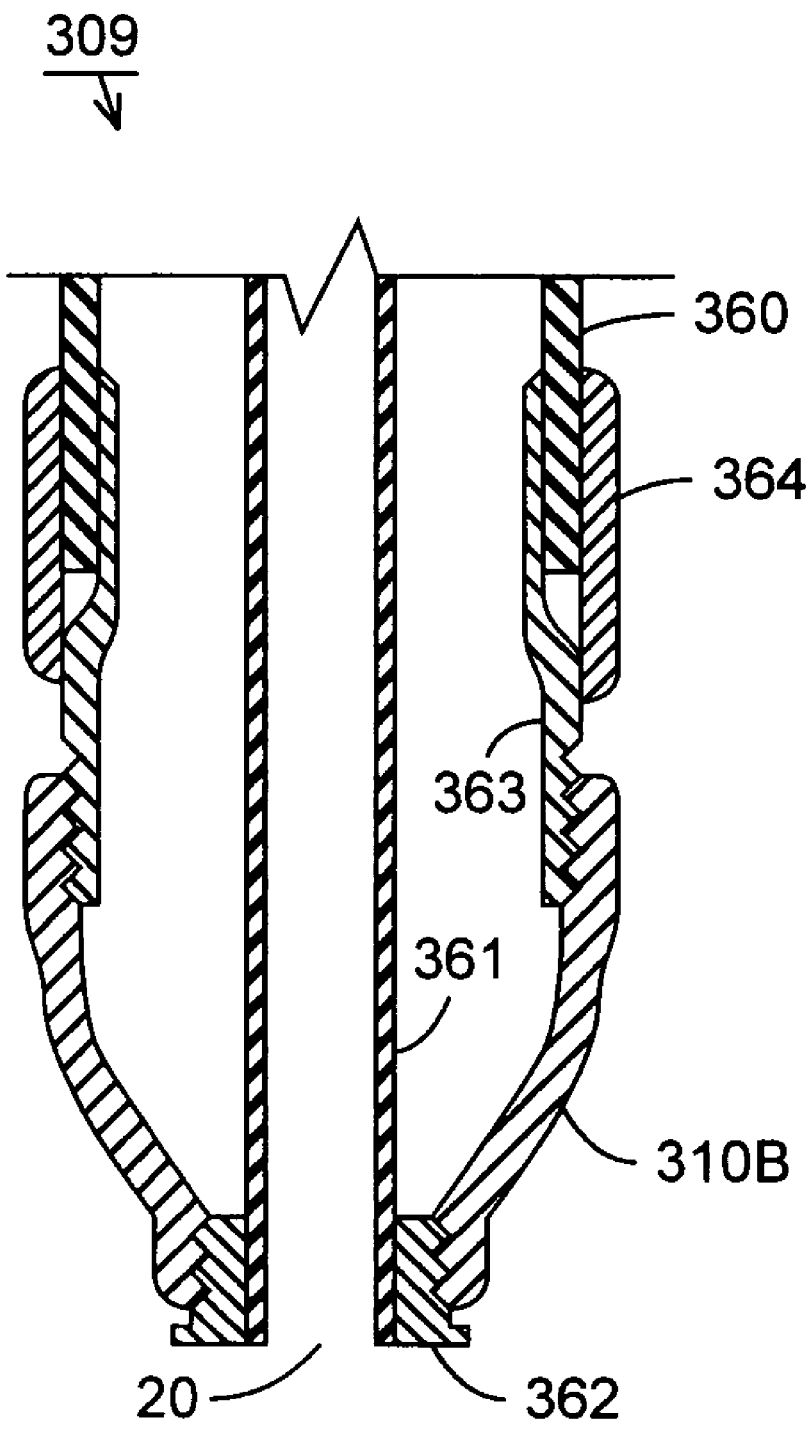

FIG. 12 illustrates a material-handling device 300 in use according to an alternate embodiment of the present invention. Generally speaking, FIG. 12 shows material-handling device 300 in cross-section, although certain components, such as the gateway 60, are shown conceptually. More detailed views showing certain of the components of device 300 are provided in FIGS. 14–18.

In FIG. 12, a significant portion of material-handling device 300 has been lowered into a well casing, pipe, riser, conduit, or uncased hole in ground 200. The following description will begin from the top end of material-handling device 300 and describe each component in turn.

Initially, a length of pneumatic hose 306, encased in a flexible support hose 305, winds around a hose reel 304. In the present embodiment of the invention, pneumatic hose 306 has a ½ inch inside diameter and is capable of sustaining nearly full vacuum to a pressure of at least 35 pounds per square inch (PSI). In addition, pneumatic hose 306 is sufficiently long for support hose 305 to support the device 300, to support the load of Material 14, and to resist the forces of friction. Currently, it is preferred to use Accuflex Industrial Hose, Ltd.'s K7160, Polyspring™ Wire-Reinforced Hose—Standard Wall for pneumatic hose 306, which has the following properties: a vacuum rating of 29.9 inches mercury (HG); a maximum working pressure at 122 degrees Fahrenheit of 70 PSI; fabricated from a PVC compound; spiral wire reinforcement prevents kinking or collapsing; a nominal inner diameter of ½ inch (although this is not critical and may, for example, vary from ¼ inch to 2 inches, depending on a variety of engineering considerations); a nominal outer diameter of ¾ inch; and approximate weight of 0.15 pound/foot (although, everything else being equal, even lower weight is more preferable); and a minimum bend radius at 70 degrees Fahrenheit of 2 inches (although generally it will not need to be so flexible and instead may have a bend radius, e.g., of 4–10 inches).

Support hose 305 preferably is Sun-Flow, Inc.'s SF-70 hose, which has the following properties: a nominal inner diameter of 2 inches (it is important that hose 305 be large enough for the pneumatic hose 306 and coupling to be pulled through it and to have adequate tension capacity ("end pull"), but small enough to easily fit through well casing 200); an end pull of 2,860 pounds (although even higher capacity generally will be preferred); a weight of 0.30 pound/foot (although even lower weight generally will be preferred); a composition of nitrile oil/weather resistant rubber, polyester reinforcement; a ribbed cover that is highly resistant to oil, abrasion & weathering; a useful temperature range of −20 degrees Fahrenheit to 200 degrees Fahrenheit (capability to sustain temperatures up to at least 150 degrees Fahrenheit generally is preferred); a wall thickness of 0.08 inch (although this generally is not important except to the extent that it affects overall size and/or weight); and a working pressure of 150 PSI (although in the present application the support hose 305 is not pressurized and, therefore, this property only is important insofar as it correlates to tension capacity).

As indicated above, pneumatic hose 306 preferably snakes through support hose 305 and is attached to the container 307. The support hose 305 also is attached to the container 307. As a result of these attachment points, the entire weight of device 300 is jointly supported by both pneumatic hose 306 and flexible support hose 305. However, because support hose 305 has significantly greater strength, it generally will support most of the weight of device 300. In fact, if pneumatic hose 306 snakes through support hose 305 with a sufficient amount of slack, support hose 305 will stretch a substantial amount before any stress is applied to pneumatic hose 306.

Hose reel 304 preferably is a conventional hose reel that may be mounted to the ground, to a trailer or to a truck. It is noted that the portion of pneumatic hose 306 enclosed within support hose 305 generally will be quite long, e.g., 30–400 feet, in order to permit device 300 to extend deeply into the ground. At the proximal end of support hose 305, pneumatic hose 306 extends further and is attached to a swivel connector on hose reel 304. At the other end of the swivel connector, a similar pneumatic hose 306 extends to a vacuum pump, air pump and/or a valve opening to the ambient air, such as in the manner shown in FIG. 10.

After exiting hose reel 304, pneumatic hose 306 and support hose 305 extends over pulley 303 and down into well 200. Preferably, pulley 303 is supported by a crane or a frame directly above the opening into well 200. If a crane is used, it can be used to pull the pulley 303 and, therefore, the entire device 300 out of the well 200.

Inside the well 200, pneumatic hose 306 connects to container 307, which attaches to gateway 60, which in turn attaches to separator 309 having inlet/outlet 20 at its bottom. Although similar components are described above, and any of such components may be used in this embodiment of the invention as well, the following discussion and accompanying drawings describe one particular configuration of a device 10.

One difference between the present embodiment and the previous embodiment is the configuration of separator 309. In the current embodiment, separator 309 is configured as a pair of coaxial tubes, with an inner tube 361 enclosed within an outer tube 360, and with tube 361 extending upwardly and terminating sooner than tube 360, such that tube 361 as an open top. The principal of operation of separator 309 is similar to that of separator 140, described above. That is, Material 14 drawn up through inlet/outlet 20 spills out of the top of tube 361 and into tube 360. Then, the heavier solids generally tend to fall to the bottom of tube 360 as the liquid level rises within tube 360 and when the liquid level is above the top of tube 361.

In the present embodiment, outer tube 360 is formed as a flexible hose with a 3-inch diameter and a length of at least 7 feet. However, in an alternate embodiment, a 4-inch diameter flexible hose (wider than the gateway 60) is used for outer tube 360, with a 4-to-3-inch bell reducer between the separator 309 and the gateway 60. The preferred type of hose to use for outer tube 360, and the preferred properties of hose 360, are the same as those described below for container 307.

Inner tube 361 preferably also is flexible, has a ¾-inch inside diameter, and is at least 7 feet long, although it generally is shorter than outer tube 360 (or at least sized so as not to extend to the same height as outer tube 360). Preferably, tube 361 is capable of sustaining nearly full vacuum and pressure of at least 50 PSI. In addition, tube 361 preferably is stiff enough to stand up inside outer hose 360 (e.g., made of PVC), although tube 361 may instead lean and/or meander within outer hose 360. In the current embodiment, inner tube 361 is a Spiralite® 710 White Spa-Flex hose, manufactured by Pacific Echo, Inc., and therefore has a bursting pressure at 140 degrees Fahrenheit of 180 PSI, a bend radius of 2 inches, and a weight of 0.23 pound/foot.

As previously noted, in certain embodiments of the invention it is preferable to omit a separator altogether. This alternate configuration is illustrated in FIG. 13. There, gateway 60 simply terminates at inlet/outlet 20, through an optional screen or filter 308. In addition, an optional bell reducer 310A preferably is used to taper the end of device 300 according to this alternate embodiment, thereby facilitating its movement through the well casing 200. More preferably, bell reducer 310A is a 3 inch female pipe thread by 2 inch female pipe thread reducer, fabricated from steel, preferably stainless steel, or any other material that is resistant to corrosion. The outside surface corners of reducer 310A preferably are rounded to further facilitate passing through rough areas inside the well 200. In this alternate embodiment, the remainder of device 300 above gateway 60 is identical to the main embodiment of device 300 discussed herein and shown in FIG. 12.

FIG. 14 is a cross-sectional view showing the connection between the flexible support hose 305 and pneumatic hose 306, on the one hand, and the container 307, on the other, in the material-handling device 300, according to the present embodiment of the invention. Using clamps 312, pneumatic hose 306 is clamped onto fitting 311, which preferably is a ½ inch hose barb to ½ inch male pipe thread fitting, fabricated from brass or another suitable material. Bushing 313, which preferably has a ½ inch female pipe thread and an outside diameter that is small enough to the within fitting 315 (described below), attaches to the other end of fitting 311 and is welded 314 to fitting 315. The fitting 315 preferably is a 2 inch hose barb to 2 inch male pipe thread fitting. Support hose 305 is attached to fitting 315 using clamps 316, which preferably are heavy duty hose clamps, each having a T-Bolt, or steel band and buckle, or being another type with minimum girth, so that portions of clamp 316 do not catch on the inside of well 200.

A bell reducer 317 threads onto the bottom end of fitting 315. The bell reducer 317 provides a transition to 3 inch female pipe thread from 2 inch female pipe thread, and has outside edges/corners shaped/rounded/smoothed to facilitate travel through well 200, especially over bumps/protrusions (irregular surface). The outside diameter of bell reducer 317 is sufficiently larger than the profile of clamps 316 to keep clamps 316 away from the irregular surface of well 200. Preferably, bell reducer 317 is the same component as would be used for bell reducer 310 in the alternate embodiment of the invention shown in FIG. 13.

A fitting 319A threads onto the bottom portion of bell reducer 317. In the current embodiment, fitting 319A is a 3 inch male pipe thread by 3 inch hose barb fitting. Clamps 320A then clamp the walls of the container 307 onto the bottom end of fitting 319A. Clamps 320A preferably are steel band and buckle clamps having a girth as small as practical and as smooth as practical, to allow bell reducer 317 to rub against inside of well 200, rather than clamps 320A.

In the preferred embodiment of the invention, container 307 is implemented as a flexible hose. In the present embodiment, container 307 is a 3-inch diameter hose, which may, for example, be up to 15 feet long (or even up to 45 feet long if it is to be used on an incline), although any size may instead be used. Preferably, container 307 is SW 309 Petrovac Hose manufactured by Titan Industries, or otherwise has dual-wire helix construction, provides full vacuum capabilities and is kink-resistant. Its cover preferably is ozone, abrasion and oil resistant. The tube cover is an extruded specially compounded Nitrile, and the reinforcement consists of multiple plies of polyester yarn with dual helix wire. The container 307 preferably has an operating temperature range of −40 degrees Fahrenheit to 180 degrees Fahrenheit, an inner diameter of 3 inches and an outer diameter of 3½ inches, a working pressure of 150 PSI, and a weight of 1.75 pounds/foot, and is rated for full vacuum. In short, container 307 preferably is flexible, sufficiently durable for the intended use within a well casing 200, capable of maintaining a vacuum, and strong enough to support the intended load of Material 14.

Preferably, the use of device 300 attempts to keep the height of the Material 14 at or below the desired maximum height 318 indicated in FIG. 14. This generally can be achieved by using a vacuum gauge and keeping the air pressure above a level that would cause the Material 14 to rise to height 318, making any necessary experimentally determined adjustment based on the facts that the vacuum gauge generally will be somewhat distant from the Material 14 and the air pressure within device 300 may vary somewhat. Such an adjustment might be particularly important if the vacuum gauge is several hundred feet above the Material 14.

FIG. 15 illustrates the connection between container 307 and gateway 60, as well as the connection between gateway 60 and separator 309. At its bottom end, container 307 clamps onto a fitting 319B that is identical to fitting 319A described above, using clamps 320B (which are identical to clamps 320A). A coupling 329A having 3 inch female pipe thread by 3 inch female pipe thread threads onto the lower end of the fitting 319B and the upper end of gateway 60.

In this regard, in the present embodiment gateway 60 is constructed using a 3-inch diameter 10-inch long pipe nipple 330 having male pipe threads at each end. In the current embodiment, nipple 330 is constructed of polyvinylchloride (PVC) schedule 80, but instead may be formed from steel or from any other suitable material. The interior of nipple 330 has been partitioned using dividing walls 331 and 332, and end caps 333 have been installed, in order to provide the required configuration. More detail regarding the physical arrangement of gateway 60 is provided below, in connection with the discussion of FIG. 17.

A coupling 329B (identical to coupling 329A) threads into the lower end of nipple 330 and into the upper end of a fitting 319C (which is identical to fitting 319A). Disposed within coupling 329B, between nipple 330 and fitting 319C, is an optional screen 350. The outer perimeter of screen 350 is sized slightly smaller than the inside of coupling 329B and sized and shaped such that the screen material is physically isolated from gateway 60. If screen 350 is used, the openings in screen 350 are sized to restrict solids that might clog the gateway 60. Clamps 320C (identical to clamps 320A) are used to clamp the upper end of separator 309 onto the lower end of fitting 319C.

FIG. 16 illustrates a cross-sectional view showing the bottom portion of separator 309 in the present embodiment of the invention. The bottom end of outer tube 360 fits over a stem 363, a ferrule 364 (with rounded corners, to facilitate passing bumps, protrusions, or other irregularities on inside surface of well 200) covers the connection, and stem 363 has been internally expanded to tube 360. The stem 363 preferably is a Titan Industries TIX30T internally expanded steel male coupling, size 3 inches, having steel male pipe threads. Generally speaking, each of the connections in device 300 may be made using the fitting/clamp arrangement described above, the stem/ferrule arrangement described in this paragraph, or any other suitable mechanism.

A bell reducer 310B (identical to bell reducer 310A) then threads to the bottom of stem 363 at its top and to a bushing 362 at its bottom end. Preferably, bushing 362 is made from PVC and has a 2-inch male pipe thread with a smooth hole through it, the hole being sized to receive the outside diameter of inner hose 361. The hose 361 and bushing 362 are then cemented together with plastic pipe cement.

Figure 17:
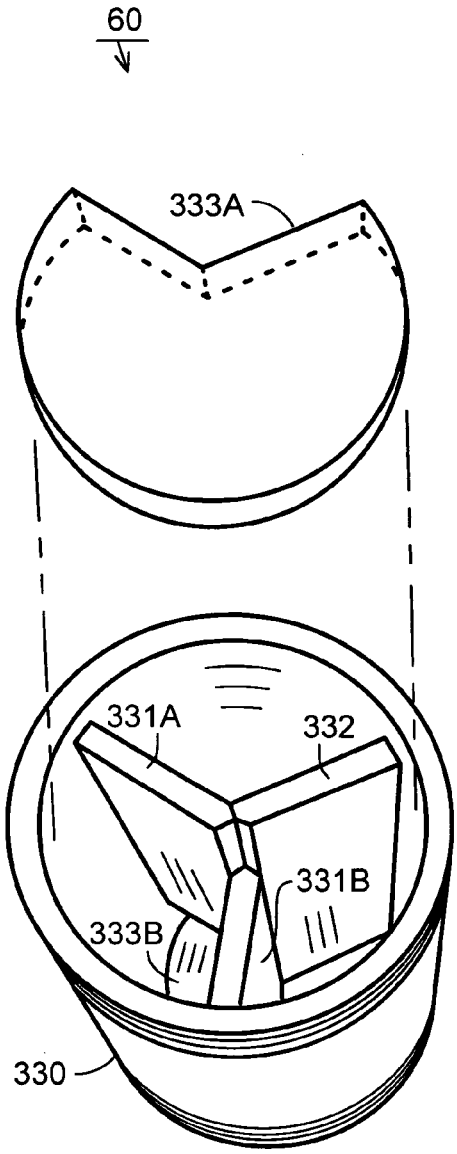
FIG. 17 is an exploded perspective view of the gateway in the material-handling device shown in FIG. 12.

FIG. 17 shows an exploded perspective view of the gateway 60 used in the present embodiment of the invention. As previously mentioned, the main body of gateway 60 is an ordinary conventional pipe nipple 330. Within pipe nipple 330 are three dividing walls (or partitions): two short partitions 331A and 331B, and one long partition 332. The types of materials from which partitions 331 and the 32 are formed typically will depend upon the type of material from which pipe nipple 330 is constructed. In the present embodiment, pipe nipple 330 is formed from PVC. Accordingly, partitions 331 and 332 also are formed from PVC (e.g., ¼-inch thick), although they may instead be formed from acrylonitrile butadiene styrene (ABS) or any other suitable material, and are cemented in place. Similarly, if pipe nipple 330 were formed from steel, it might also be preferable to form partitions 331 and 332 from steel (e.g., and welded in place, rather than cemented).

For cemented joints, edges that join to other components (e.g., dividing walls attaching to other dividing walls at a centerline or attaching to the inside surface of pipe nipple 330) preferably are slightly beveled, to facilitate cement to flow in and fill the gap. The cement utilized may, for example, be multi-purpose cement or PVC cement. For welded joints, the edge preferably is shaped as necessary.

At the end of gateway 60 that is illustrated in FIG. 17, one of the partitions 331A and the partition 332 are at a height so as to abut end cap 333A, while the other of the partitions 331B is lower, providing a gap between partition 331B and end cap 333A. At the other end of gateway 60 (not shown) the view is identical, except that at that end partition 331B and partition 332 extend so as to abut the other end cap 333*b* (partially shown inside the pipe nipple 330), while partition 331A does not extend that far, providing a gap between partition 331A and the opposite end cap 333B. At each end, the gap preferably is at least approximately one-half of the diameter of pipe nipple 330. Preferably, the dividing walls 331 and 332 meet at a center line of pipe nipple 330 and divide into the interior of pipe nipple 330 into three approximately equally sized flow paths.

The end cap 333A at the end of gateway 60 that is illustrated in FIG. 17 covers the end of pipe nipple 330, other than the space between dividing wall 331A and dividing wall 332. At the other end, end cap 333B covers the end of pipe nipple 330, other than the space between dividing wall 331B and dividing wall 332. In the preferred embodiment of the invention, the end caps 333 are removable, in order to facilitate clearing any clogs from the (otherwise hard to reach) flow path created by the two short partitions 331. In such a case, it generally may be preferable to extend dividing wall 331A and dividing wall 332 at the illustrated end (and dividing wall 331B and dividing wall 332 at the other end) to the very end of pipe nipple 330, and then to attach end cap 333A (or the opposite end cap at the other end), e.g. using a clamping mechanism. In any event, if the end caps 333 are in fact removable, it generally will be preferable to attach a softer (e.g., rubber-like) substance to the inside surface of each end cap 333 in order to obtain a better seal when the end caps 333 are attached.

However, it also is possible to permanently cement end caps 333 onto gateway 60, e.g., by applying cement to the tops of dividing walls 331A and 332 and to a portion of the inside surface of pipe nipple 330, and then fitting end cap 333A into the end of pipe nipple 330. A similar procedure would be performed at the other end of pipe nipple 330, except that at that end cement would be applied to the tops of dividing walls 331B and 332.

It is noted that in the current embodiment of the invention, the joints in gateway 60 (whether cemented, welded or clamped) must be air-tight and liquid-tight, from nearly full vacuum to the maximum design pressure (e.g., 50 PSI). In addition, such joints must be strong enough to resist the forces created by unequal pressures on opposing sides of components of gateway 60.

As with the dividing walls 331 and 332, end caps 333 may be formed from ¼-inch thick PVC or ABS, or even may be made from steel. In the present embodiment, the shape of each end cap 333 is two-thirds of a circle, leaving the remaining one-third for the Material 14 to flow in and out of gateway 60.

Figure 18:
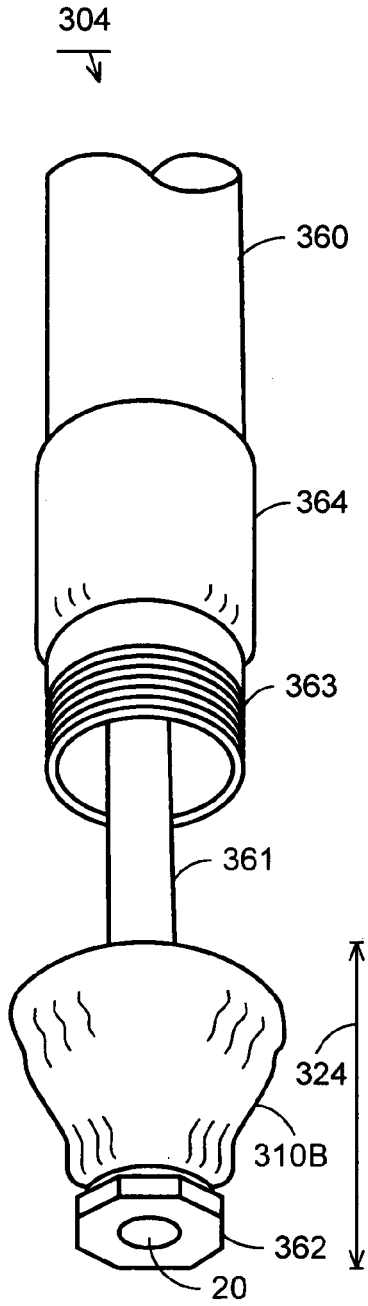
FIG. 18 is a perspective view of the separator with its end cap removed in the material-handling device shown in FIG. 12.

FIG. 18 is a perspective view of separator 309 with its end cap 324 removed. In this configuration, solids and other Materials 14 that have accumulated in separator 309 may be emptied out of separator 309. Once this has been accomplished, bell reducer 310B may be simply screwed back into fitting 319 so as to reattach bell reducer 310B to remainder of separator 309. It is noted that inner tube 361 remains attached to bushing 362 and in turn to bell reducer 310B during this process.

In an alternate technique, separator 309 may be detached at its top end (e.g., by removing clamps 320C or by unscrewing fitting 319C from coupling 329B). Still further, separator 309 may be provided with a detachable cap (either on its bottom surface, such as cap 147 shown in FIG. 11, or anywhere else on separator 309).

Additional Variations

In several of the above-described embodiments, both a gateway 30 and a separator 140 or 309 are utilized. However, in certain applications it may be desirable to use one or the other, but not both. FIGS. 1, 10 and 13 illustrate examples of devices 10, 120 and 300 in which a gateway 30 is utilized, but not a separator 140 or 309.

Similarly, the device 130 or 300 illustrated in FIG. 11 or 12, respectively, may be modified by omitting the gateway 30, respectively, and connecting the separator (e.g., 140 or 309), respectively, directly to the container 80, respectively. An example of the usefulness of such a configuration is described in detail below.

In addition, or instead, a multi-stage separator may be utilized in any of the embodiments described above, e.g., with each stage being identical to the separator 140 illustrated in FIG. 11 or separator 309 illustrated in FIG. 12.

In the above-described embodiment, gateway 30 preferably is fabricated as a rigid component that detachably attaches to the bottom of a container (e.g., by threading or clamping onto the bottom of container), with the separate sections being formed by cementing the appropriately shaped plates within the interior and caps at the ends of gateway. For this embodiment, the various components of gateway 30 may be fabricated from PVC, ABS, any other type of plastic, any composite material, steel, brass or any other metal. Alternatively, they may be formed from flexible materials.

Also, material-handling devices according to the above-described embodiments may be provided with spacers covering portions of the device 10 that is inserted into the well casing 200, in order to prevent uneven sections of those portions from contacting the inner wall of well casing 200.

As noted above, all or nearly all of the components of device 10 preferably are flexible (although this is not necessary in alternate applications of the device 10). Where flexible components are used (such as in the well-cleanout applications), all of such flexible components preferably have a bend radius of no more than 4, 8 or 12 inches (although this may vary depending on the intended use and the sizes of any pulleys or similar devises used).

In the foregoing embodiments pertaining to well cleanout, air pressure is controlled by connecting an air-pressure control device 100 to a container 80 via a pneumatic hose enclosed within a flexible support hose. Although this configuration is preferred, it is not critical. Instead, the link between the air-pressure control device 100 and container 80 may consist of a single flexible hose (which may or may not strictly be a "pneumatic" hose, as that term is normally used). Still further, a non-flexible or rigid link (e.g., a pipe string) may be used in certain embodiments, where appropriate.

Application of a Form of the Device to Clean Out Wells

The form of the devices 130 and 300 has the ability to travel through well and riser casings 200 that curve, bend, have partial restrictions, and/or have uneven inside surfaces. Such a device 130 or 300 will remove liquids mixed with solids and generally has no valves that the Material 14 would contact; accordingly, it generally will be more reliable than conventional devices. In addition, such a device 130 or 300 typically can operate without electricity inside the well or riser casing 200, thereby minimizing the possibility of ignition.

Refer to FIG. 11 and/or FIG. 12 for the general arrangement of the components for this form of the invention. In order to simplify the discussion, references below will be to material-handling device 300, illustrated in FIG. 12. However, it should be understood that the discussion also applies to device 130, illustrated in FIG. 11, as well as to various other devices within the scope of the present invention.

1. The lead end of the device 300 (having inlet/outlet 20) is lowered into the casing of the well or riser pipe 200, which can be vertical or at an angle from vertical.

2. The lead end of the device 300 is suspended from a flexible support hose 305, which is capable of carrying the tensile force of the hanging portion of the device 300 plus the load of the Material 14 being removed. The flexible support hose 305 contains the pneumatic hose 306. The flexible support hose 305 and pneumatic hose 306 can be one item, if the height, weight, strength, volume, abrasion-resistance, surface friction, durability and other requirements are met by a single product.

3. The flexible support hose 305 with inner pneumatic hose 306 are stored and wound on a hose reel 304, which unwinds as the lead end and hoses 305 and 306 are fed into the well 200.

4. The lead end of the device 300 is lowered until the bottom, open, end of the separator 309 reaches the Material 14 to be removed, and is submerged in a liquid. Liquid can be added from above ground, if needed.

5. Suction is applied at the hose-reel end of the pneumatic hose 306. As the air pressure decreases throughout the pneumatic hose 306, container 307, gateway 60, and separator 309, a load of Material 14 will be drawn into the separator 309, which will separate and hold the heavier and/or larger solids, and allow remaining Material 14 to pass through and up.

6. The remaining Material 14 will travel through the gateway 60.

7. The remaining Material 14 will flow into and up the container 307, which will accumulate the remaining Material 14.

8. When the air pressure in the pneumatic hose 306 has been reduced to the desired low pressure, corresponding to the desired height of suctioned Material 14 in the container 307, the air pressure is maintained at the desired low pressure.

9. The lead end of the device 300 is lifted above the liquid surface 12. The gateway 60 will prevent the Material 14 in the container 307 from discharging from the container 307, as long as the low pressure (suction) is maintained.

10. The remainder of the device is withdrawn from the well 200, as the flexible support hose 305 with pneumatic hose 306 are wound on the hose reel 304.

11. The lead end of the device 300 is positioned over a storage container on the ground.

12. The suction is released, allowing air into the pneumatic hose 306 and container 307. As the air pressure within the device 300 increases, the Material 14 flows down and out of the container 307, through the gateway 60, through the separator 309, and into the storage container.

13. The solids in the separator 309 are removed by removing a cap 324, removing the solids, and replacing the cap 324.

14. The device is repositioned over the casing of the well or riser pipe 200.

The cycle can be repeated, to lift more Material 14 from the bottom of the casing of well 200.

A number of variations are possible on the above-described procedure. For instance, the rate at which the vacuum is created can be controlled by selectively using either or both of valves 106 and 116 and/or by controlling the operation of vacuum pump 102. In this regard, for example, air may be initially evacuated from the vacuum chamber 104, with valve 116 open and valve 106 closed. Once this has been accomplished, valve 116 is closed. Then, when it is desired to begin extracting the Material 14 from pool 12, valve 106 is opened, allowing vacuum pump 102 to begin evacuating air from the device 300. When the air pressure within device 300 has dropped to a desired threshold, valve 116 may be opened, causing vacuum chamber 104 to assist in evacuating air from device 300, which in turn will cause Material 14 to be drawn into device 300 faster.

In addition, or instead, once the Material 14 has been drawn into device 300 to the desired height, the operator of device 300 may wait a period of time, such as a few minutes, for the heavier solids to settle out into separator 309. At this point, the partial vacuum within device 300 may be released, e.g., by opening valve 108, thereby causing the Material 14 to fall out of device 300. Thereafter, Material 14 may again be drawn into device 300, and this process of drawing Material 14 into device 300 and then flushing it out may be repeated any desired number of times prior to lifting device 300 out of well casing 200. One benefit of doing this is that doing so often makes it possible to remove a greater quantity of solid Materials more efficiently. That is, each time Material 14 is drawn into device 300 separator 309 fills with additional solid Material. Accordingly, the foregoing process may be repeated until separator 309 is completely full (or, in the absence of an ability to determine the state of separator 309, until it is assumed that separator 309 is completely full).

It is noted that the foregoing technique of utilizing repeated cycles of drawing up and flushing out Material 14 may be utilized in connection with a device 300 that does not include any gateway 30. If the size of the inlet/outlet 20 is sufficiently large in this case (which generally will be the case), then all of the liquid Material (except the portion within outer tube 360 below the top of tube 361) within the device will fall out once the device has been removed from the pool 12 of Material 14. However, if the main goal is to remove larger solids from the well, then it may not be necessary to withdraw the fluid portion and smaller/suspended solids of the Material 14. In fact, if it is desired to remove such fluids, it might be more efficient to simply lower a pump into the well (e.g., in the conventional manner) after a sufficient quantity of the solids have been removed using the foregoing technique.

Also, in the above description, the Material 14 is discharged from device 300 by simply opening valve 108 to expose the internal cavities of device 300 to ambient air pressure. However, with the use of air from 103, air tank 105 and/or control valve 107, it is possible to use greater pressure in discharging such Material 14. Such a technique has been found to be useful in cleaning out some of the solid particles that otherwise would accumulate in the gateway 30 and/or in other components of device 300.

Features of the Device

The above-described embodiments of the invention primarily focus on the invention's application in connection with large-scale well-cleanout operations. However, in its simplest form, the device 10 of the present invention can be seen as an improvement over a conventional "eye dropper" or "turkey baster" concept because it includes a gateway 30 instead of a narrow pathway at the bottom. The gateway 30 allows the bottom opening 20 and the device 10 to be any desired size, while the gateway 30 prevents the load from falling out. Optional components described above add functionality, versatility, and or economy.

Therefore:

1. The device 10 can be scaled to nearly any size.

2. The device 10 can acquire, hold and release fluids of any viscosity and mixtures of fluids and solids.

3. The device 10 can acquire the load of the subject Material 14 from the top surface or from below the top surface of the subject material, and the subject Material 14 does not have to begin in a movable container.

4. The device 10 has no moving parts that contact the subject Material 14, and thus is able to acquire mixtures of fluids and solids, while minimizing degradation of the solids, minimizing maintenance of the device 10, and maximizing reliability of the device 10.

5. The device 10 does not require electricity that might cause ignition within combustible gases or might cause interference with other devices.

6. The device 10 can be constructed from a wide variety of materials, including plastics, glass, metal, and ceramic.

7. The rate at which the air pressure is decreased and increased can vary from slow to fast, to suit applications. The faster the air pressure is decreased, the faster the in-rush of subject Material 14, and the larger the solids that can be acquired.

8. The low pressure attained in the device 10 can be controlled from slight to full vacuum.

9. Controlling the rate at which air is allowed into the container 80 can control the rate at which the Material 14 is released. Air can be pumped into the container 80 to increase the release rate beyond the rate caused by ambient pressure.

Potential Applications

1. Kitchen utensil.

2. Laboratory tool.

3. Commercial food preparation, dispensing, packaging.

4. Manufacturing processes.

5. Clean out plumbing, pipes, storm drains, sewers, and manholes.

6. Clean up spills, including hazardous materials.

7. Remove mud and debris.

8. Applications requiring the materials to be lifted higher than a complete vacuum is capable of suctioning (approximately 34 feet for water; less for materials of higher density).

9. Filling water tank of aircraft hovering over a body of water, such as for fire-fighting applications.

10. Dredging, mining, an alternative to drilling, and other forms of excavating.

11. Applications requiring material to be lifted higher than is feasible, practical or economical for a single-stage or multi-stage pump.

12. Applications where a conventional pump would degrade the material or not function, due to the size and/or quantity of solids mixed in the Material 14.

13. Applications in which the Material 14 is to be lifted and removed from a well, such as water, oil, and gas wells. The application can be normal production use and/or occasional use to clean out and/or retrieve items that fell into the well.

In the commercial and/or industrial applications mentioned above, a device 10 according to the present invention, for example, may be used for accumulating and/or discharging Material 14 in connection with a conveyor belt system.

Additional Considerations

Several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Similarly, in the discussion above, functionality may be ascribed to a particular module or component. However, unless any particular functionality is described above as being critical to the referenced module or component, functionality may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

What is claimed is:

1. An apparatus for extracting, transporting and/or releasing liquid or semi-liquid material, said apparatus comprising:

(a) a container;

(b) an inlet/outlet for allowing material to enter and exit the apparatus;

(c) a gateway disposed within a path between the container and the inlet/outlet, the gateway comprising an enclosed channel that has an interior surface; and (d) pressure-control means for controlling gas pressure within the container, wherein in tracing a pathway through the enclosed channel of the gateway, starting from the inlet/outlet side of the gateway and ending at the container side of the gateway, with the apparatus in its operational position, the pathway first passes above a first point on the interior surface of the enclosed channel and then underneath a second point on the interior surface of the enclosed channel, wherein the first point is higher than the second point with the apparatus in its operational position, wherein the apparatus is configured such that, when in operational use, the material entering the inlet/outlet does not flow into or past the pressure-control means, and wherein the inlet/outlet has a minimum dimension that is at least ¼ inch in length.

2. An apparatus according to claim 1, wherein the gateway is disposed in close proximity to the inlet/outlet.

3. An apparatus according to claim 1, wherein the pressure-control means comprises a pump for pumping gas out of the container.

4. An apparatus according to claim 1, wherein the pressure-control means comprises a valve configured to control an opening between the container and ambient air.

5. An apparatus according to claim 1, wherein the container is flexible.

6. An apparatus according to claim 1, wherein the gateway comprises a rigid fitting.

7. An apparatus according to claim 1, wherein the gateway comprises an S-shaped tube.

8. An apparatus according to claim 1, wherein the pressure-control means connects to the container via a flexible hose of at least 25 feet in length.

9. An apparatus according to claim 8, wherein the flexible hose is at least 50 feet in length.

10. An apparatus according to claim 8, wherein the flexible hose encloses a pneumatic hose.

11. An apparatus according to claim 8, wherein the apparatus, from and including the flexible hose to and including the inlet/outlet, is at least 35 feet in length.

12. An apparatus according to claim 11, wherein the apparatus, from and including the flexible hose to and including the inlet/outlet, is substantially entirely flexible.

13. An apparatus according to claim 1, further comprising separator means disposed between the inlet/outlet and the gateway for collecting solids.

14. An apparatus according to claim 13, wherein the separator means comprises a vertically extending first tube enclosed within a vertically extending second tube, wherein the first tube is open at its top, and wherein the second tube has a bottom surface for collecting material that spills out of the top of the first tube.

15. An apparatus according to claim 14, wherein both the first tube and the second tube are flexible.

16. An apparatus according to claim 13, wherein at least a portion of the separator means is readily detachable and re-attachable for emptying material that collects in the separator means.

17. An apparatus according to claim 1, wherein the inlet/outlet has a minimum dimension that is at least ½ inch in length.

18. An apparatus according to claim 1, wherein the inlet/outlet has a minimum dimension that is at least ¾ inch in length.

19. An apparatus according to claim 1, wherein the inlet/outlet has a minimum dimension that is at least 1 inch in length.

20. An apparatus according to claim 1, wherein the inlet/outlet has a minimum dimension that is at least 1½ inch in length.

21. An apparatus according to claim 1, wherein the inlet/outlet has a minimum dimension that is at least 2 inches in length.

22. An apparatus according to claim 1, wherein the inlet/outlet has a minimum dimension that is at least 4 inches in length.

23. An apparatus for extracting, transporting and/or releasing liquid or semi-liquid material, said apparatus comprising:

(a) a container;

(b) an inlet/outlet for allowing material to enter and exit the apparatus;

(c) a gateway disposed within a path between the container and the inlet/outlet, the gateway comprising an enclosed channel that has an interior surface; and (d) pressure-control means for controlling gas pressure within the container, wherein in tracing a pathway through the enclosed channel of the gateway, starting from the inlet/outlet side of the gateway and ending at the container side of the gateway, with the apparatus in its operational position, the pathway first passes above a first point on the interior surface of the enclosed channel and then underneath a second point on the interior surface of the enclosed channel, wherein the first point is higher than the second point with the apparatus in its operational position, wherein the apparatus is configured such that, when in operational use, the material entering the inlet/outlet does not flow into or past the pressure-control means, and wherein the inlet/outlet has a size and a shape such that a vacuum alone would not be sufficient to prevent water from falling out of the inlet/outlet.

24. An apparatus for extracting, transporting and/or releasing liquid or semi-liquid material, said apparatus comprising:

(a) a container;

(b) an inlet/outlet for allowing material to enter and exit the apparatus;

(c) a gateway disposed within a path between the container and the inlet/outlet, the gateway comprising an enclosed channel that has an interior surface; and (d) pressure-control means coupled to the container for controlling gas pressure within the container, wherein in tracing a pathway through the enclosed channel of the gateway, starting from the inlet/outlet side of the gateway and ending at the container side of the gateway, with the apparatus in its operational position, the pathway first passes above a first point on the interior surface of the enclosed channel and then underneath a second point on the interior surface of the enclosed channel, wherein the first point is higher than the second point with the apparatus in its operational position, wherein the apparatus is configured such that, when in operational use, the material entering the inlet/outlet does not flow into or past the pressure-control means, and wherein the pressure-control means comprises at least one of an electrically or mechanically actuated pump or valve.

* * * * *